US008936697B2

(12) United States Patent
Scharpf et al.

(10) Patent No.: US 8,936,697 B2
(45) Date of Patent: Jan. 20, 2015

(54) HIGHLY ABSORBENT AND RETENTIVE FIBER MATERIAL

(75) Inventors: Elizabeth Scharpf, New York, NY (US); Liying Huang, San Diego, CA (US); Hannah Brice, Witney (GB); Joshua Velson, White Plains, NY (US); Sina Salehi Omran, Cambridge, MA (US); Jeffrey Zhou, Getzville, NY (US); Rachel B. Licht, Berkeley, CA (US); Clark K. Colton, Newton, MA (US); William H. Dalzell, Marshfield, MA (US)

(73) Assignee: Sustainable Health Enterprises, New York, NY (US)

( * ) Notice: Subject to any disclaimer, the term of this patent is extended or adjusted under 35 U.S.C. 154(b) by 0 days.

(21) Appl. No.: 12/985,301

(22) Filed: Jan. 5, 2011
(Under 37 CFR 1.47)

(65) Prior Publication Data

US 2012/0097351 A1 Apr. 26, 2012

Related U.S. Application Data

(60) Provisional application No. 61/292,692, filed on Jan. 6, 2010.

(51) Int. Cl.

| | |
|---|---|
| ***D21C 1/02*** | (2006.01) |
| ***D21H 11/08*** | (2006.01) |
| ***D21C 9/00*** | (2006.01) |
| ***D21H 11/16*** | (2006.01) |

(52) U.S. Cl.

CPC ..... *D21H 11/08* (2013.01); *D21C 1/02* (2013.01); *D21C 9/007* (2013.01); *D21H 11/16* (2013.01)

USPC ..... 162/9; 162/13; 162/28; 162/99; 162/100; 162/189; 241/24.19; 241/28; 241/29

(58) Field of Classification Search

CPC ..... D21C 9/007; D21C 5/02; D21C 9/001; D21C 1/02; D21C 9/002; D21C 9/004; D21B 1/026; D21B 1/32; D21F 11/14; D21F 9/02; B27N 3/007; B27N 3/04; D21H 11/16; D21H 11/08

USPC ..... 162/9, 12, 28, 90, 99, 100, 141, 162/147–148, 182, 189, 202, 204, 13; 241/24.19, 25, 28–29

See application file for complete search history.

(56) References Cited

U.S. PATENT DOCUMENTS

| | | | | | |
|---|---|---|---|---|---|
| 1,005,354 | A | | 10/1911 | Strong | |
| 1,181,553 | A | | 5/1916 | Taylor et al. | |
| 1,981,883 | A | | 11/1934 | Tappan et al. | |
| 3,519,211 | A | * | 7/1970 | Marsan et al. | 241/18 |
| 3,658,613 | A | | 4/1972 | Steiger | |
| 3,750,962 | A | * | 8/1973 | Morgan, Jr. | 241/18 |
| 3,756,913 | A | * | 9/1973 | Wodka | 62/183 |
| 3,809,604 | A | * | 5/1974 | Estes | 62/100 |
| 3,987,968 | A | | 10/1976 | Moore et al. | |
| 4,065,347 | A | * | 12/1977 | Aberg et al. | 162/26 |
| 4,081,316 | A | * | 3/1978 | Aberg et al. | 162/4 |
| 4,247,362 | A | * | 1/1981 | Williams | 162/13 |
| 4,444,830 | A | | 4/1984 | Erickson | |
| 4,455,237 | A | * | 6/1984 | Kinsley | 210/767 |
| 4,464,224 | A | * | 8/1984 | Matolcsy | 162/111 |
| 4,853,086 | A | * | 8/1989 | Graef | 162/157.6 |
| 5,183,707 | A | * | 2/1993 | Herron et al. | 428/364 |
| 5,536,369 | A | * | 7/1996 | Norlander | 162/157.6 |
| 5,589,256 | A | | 12/1996 | Hansen et al. | |
| 5,779,857 | A | * | 7/1998 | Norlander | 162/157.6 |
| 5,958,182 | A | | 9/1999 | Hondroulis et al. | |
| 6,024,834 | A | | 2/2000 | Horton, Jr. et al. | |
| 6,027,652 | A | | 2/2000 | Hondroulis et al. | |
| 6,059,924 | A | | 5/2000 | Hoskins | |
| 6,207,013 | B1 | | 3/2001 | Oriaran et al. | |
| 6,409,841 | B1 | | 6/2002 | Lombard | |
| 6,413,362 | B1 | | 7/2002 | Hu | |
| 6,436,231 | B1 | * | 8/2002 | Graef et al. | 162/9 |
| 6,506,307 | B1 | | 1/2003 | Hondroulis et al. | |
| 6,533,898 | B2 | * | 3/2003 | Gross | 162/158 |
| 6,800,319 | B1 | | 10/2004 | Hulst et al. | |
| 2002/0059993 | A1 | * | 5/2002 | Tanner et al. | 162/21 |
| 2002/0096276 | A1 | * | 7/2002 | Leithem et al. | 162/90 |
| 2003/0089478 | A1 | * | 5/2003 | Tanner et al. | 162/261 |
| 2005/0061827 | A1 | | 3/2005 | Yardley et al. | |
| 2005/0137547 | A1 | * | 6/2005 | Garnier et al. | 604/375 |
| 2006/0060319 | A1 | | 3/2006 | Kokko | |
| 2007/0277947 | A1 | * | 12/2007 | Nguyen | 162/71 |
| 2009/0199349 | A1 | | 8/2009 | Weinstein | |
| 2011/0034891 | A1 | * | 2/2011 | Jiang et al. | 604/358 |
| 2011/0209839 | A1 | * | 9/2011 | Leithem et al. | 162/90 |
| 2011/0287275 | A1 | * | 11/2011 | Tan et al. | 428/532 |
| 2012/0097351 | A1 | * | 4/2012 | Scharpf et al. | 162/100 |
| 2013/0213594 | A1 | * | 8/2013 | Jaakkola et al. | 162/123 |
| 2013/0252293 | A1 | * | 9/2013 | Chen et al. | 435/139 |
| 2014/0000827 | A1 | * | 1/2014 | Jiang et al. | 162/162 |

FOREIGN PATENT DOCUMENTS

| | | | | |
|---|---|---|---|---|
| GB | 2269603 | A | * | 2/1994 |
| SU | 690104 | A | * | 10/1979 |
| WO | WO-95/25844 | | | 9/1995 |
| WO | WO 2011085038 | A1 | * | 7/2011 |

OTHER PUBLICATIONS

Khalil et al. (2006). "Chemical composition, anatomy, lignin distribution, and cell wall structure of Malaysian plant waste fibers," BioRes. 1(2), 220-232.

International Search Report and Written Opinion mailed Apr. 4, 2011, for PCT Application No. PCT/US2011/20270 filed Jan. 5, 2011, 8 pages.

* cited by examiner

*Primary Examiner* — Jose Fortuna
(74) *Attorney, Agent, or Firm* — Morrison & Foerster LLP

(57) ABSTRACT

A process for producing a water-absorbent high-porosity fibrous matrix from lignocellulosic raw materials, comprising wet mechanical processing of the raw material, drying, and then dry mechanical processing the fibers to provide a fibrous matrix is provided. The high-porosity fibrous matrix and absorbent articles prepared therefrom are also provided.

6 Claims, 15 Drawing Sheets

Figure 5

| Absorption | Run # | Raw | RW | US | 8% OH TT | 2% CO3 TT | K TT | M | B | B F | 2% OH SE | 8% OH SE | 2% CO3 SE | M 2% OH SE | 8% OH TT B | 8% OH TT B F | M 8% OH TT B F | B 8% OH TT B F | B 8% OH TT 8% B F | M 2% CO3 TT B F |
|---|---|---|---|---|---|---|---|---|---|---|---|---|---|---|---|---|---|---|---|---|
| **Run #** | | 1 | 2 | 3 | 4 | 5 | 6 | 7 | 8 | 9 | 10 | 11 | 12 | 13 | 14 | 15 | 16 | 17 | 18 | 19 |
| Raw | 1 | x | | | | | | | | | | | | | | | | | | |
| RW | 2 | | x | | | | | | | | | | | | | | | | | |
| US | 3 | | | x | | | | | | | | | | | | | | | | |
| 8% OH TT | 4 | | + | + | x | | | | | | | | | | | | | | | |
| 2% CO3 TT | 5 | | | + | | x | | | | | | | | | | | | | | |
| K TT | 6 | | + | + | + | + | x | | | | | | | | | | | | | |
| M | 7 | | + | + | | | | x | | | | | | | | | | | | |
| B | 8 | | | + | | | | | x | | | | | | | | | | | |
| B F | 9 | | | | | | | | | x | | | | | | | | | | |
| 2% OH SE | 10 | | + | + | | | | | | + | x | | | | | | | | | |
| 8% OH SE | 11 | | + | + | | + | | | | + | | x | | | | | | | | |
| 2% CO3 SE | 12 | | + | + | | | | | | + | | | x | | | | | | | |
| M 2% OH SE | 13 | | + | + | | + | | | | + | | | | x | | | | | | |
| 8% OH TT B | 14 | + | + | + | + | + | | + | + | + | + | + | + | + | x | | | | | |
| 8% OH TT B F | 15 | | | | | | | | | + | | | | | | x | | | | |
| B 8% OH TT B F | 16 | | | | | | | | | + | | | | | | | x | | | |
| M 8% OH TT B F | 17 | | + | | | | | | | + | | | | | | | | x | | |
| B 8% OH TT 8% B F | 18 | | | | | | | | | | | | | | | | | | x | |
| M 2% CO3 TT B F | 19 | | + | + | + | + | | + | + | + | + | + | + | + | | + | + | + | + | x |

Key:
statistically different at 95% confidence (left > top)
not statistically different
+ statistically different at 95% confidence (top > left)

Figure 7

| Retention | Run # | Raw | RW | US | 8% OH TT | 2% CO TT | K TT | M | B | B F | 2% OH SE | 8% OH SE | 2% CO SE | M 2% OH SE | 8% OH TT B | 8% OH TT B F | M 8% OH TT B F | B 8% OH TT B F | M 8% OH TT 80 B F | M 2% CO3 TT B F |
|---|---|---|---|---|---|---|---|---|---|---|---|---|---|---|---|---|---|---|---|---|
| Run # | | 1 | 2 | 3 | 4 | 5 | 6 | 7 | 8 | 9 | 10 | 11 | 12 | 13 | 14 | 15 | 16 | 17 | 18 | 19 |
| Raw | 1 | x | | | | | | | | | | | | | | | | | | |
| RW | 2 | | x | | | | | | | | | | | | | | | | | |
| US | 3 | | | x | | | | | | | | | | | | | | | | |
| 8% OH TT | 4 | | | | x | | | | | | | | | | | | | | | |
| 2% CO3 TT | 5 | | | | | x | | | | | | | | | | | | | | |
| K TT | 6 | | | | | | x | | | | | | | | | | | | | |
| M | 7 | | | | | | | x | | | | | | | | | | | | |
| B | 8 | | | | | | | | x | | | | | | | | | | | |
| B F | 9 | | | | | | | | | x | | | | | | | | | | |
| 2% OH SE | 10 | | | | | | | | | | x | | | | | | | | | |
| 8% OH SE | 11 | | | | | | | | | | | x | | | | | | | | |
| 2% CO SE | 12 | | | | | | | | | | | | x | | | | | | | |
| M 2% OH SE | 13 | | | | | | | | | | | | | x | | | | | | |
| 8% OH TT B | 14 | | | | | | | | | | | | | | x | | | | | |
| 8% OH TT B F | 15 | | | | | | | | | | | | | | | x | | | | |
| B 8% OH TT B F | 16 | | | | | | | | | | | | | | | | x | | | |
| M 8% OH TT B F | 17 | | | | | | | | | | | | | | | | | x | | |
| B 8% OH TT 80 B F | 18 | | | | | | | | | | | | | | | | | | x | |
| M 2% CO3 TT B F | 19 | | | | | | | | | | | | | | | | | | | x |

Key:

statistically different to 95% confidence (left > top)

not statistically different statistically different to 95% confidence (top > left)

HIGHLY ABSORBENT AND RETENTIVE FIBER MATERIAL

CROSS-REFERENCE TO RELATED APPLICATION

This application claims benefit of priority to U.S. Provisional Application Ser. No. 61/292,692, filed 6 Jan. 2010. The content of this document is incorporated herein by reference in its entirety.

FIELD OF THE INVENTION

This disclosure relates to a process for producing a water-absorbent high-porosity fibrous matrix from mechanically processed lignocellulosic raw materials. The invention further relates to the water-absorbent high-porosity fibrous matrix produced through this process, and to uses thereof, for example in the production of water absorbent articles of manufacture.

BACKGROUND

There is general interest in developing commercially viable uses for agricultural by-products. Such by-products have the advantage of being abundant, renewable and relatively low cost sources of lignocellulosic raw materials. In addition, the production of large volumes of agricultural by-products may present a significant waste problem that raises both economic and environmental concerns. See Khalil et al. (2006) *BioResources* 1(2), 220-232.

Traditional methods of processing agricultural by-products and similar materials involve the use of acidic or alkaline chemical processes to break down or modify the fiber structure. Chemical methods for processing lignocellulosic biomass hydrolyze the polymers that make up their structure, wherein the choice of chemical process depends on the biomass structure and desired product. Most reactions used in the paper industry are alkaline in nature, such as the Kraft or sulfate process, which uses a solution of sodium sulfide and sodium hydroxide to digest the lignocellulosic material. Other methods based on the paper industry include soda (alkali) process, which involves digestion with 8% (w/w) sodium hydroxide solution to hydrolyze lignin at 170° C. and saturation pressure at this temperature.

In addition to generating undesirable waste streams, such processes are often complex, expensive, and require the use of specialized equipment and toxic or corrosive chemicals under controlled conditions. These traditional chemical processes are particularly dangerous and impracticable in many developing countries, which may lack the facilities and/or infrastructure to deal with these issues.

Agricultural by-products have been used for the production of various composite, textile, pulp and paper products. In addition, such materials have been explored for the production of fuel, as a source of chemicals, for the sequestration of heavy metals, and for other uses. For example, U.S. Pat. Nos. 6,027,652 and 6,506,307 describes a process for sorbing hydrophobic liquids, such as oil and gasoline, using tropical fibers. U.S. Pat. No. 5,958,182 describes a process for converting tropical materials into fibers useful in paper-making, textiles, insulation and other uses.

International Publication WO 95/25844 describes the preparation of high lignin content cellulosic fibers for use in absorbent structures by fluffing high lignin content fibers in air at elevated temperatures. U.S. Pat. No. 4,444,830 describes a process for preparing an absorbent fibrous hydrophilic fluff which contains absorbent polymer platelets distributed throughout the matrix, but does not describe the use of agricultural by-products. U.S. Pat. No. 6,059,924 describes a process for producing fluffed pulp having enhanced liquid wicking and retention by refining a chemical pulp slurry.

In the developing world, the agricultural by-products of many tropical plants represent an abundant and under-utilized source of lignocellulosic raw materials for a variety of applications. One potential use for such agricultural by-products is the production of water absorbent materials having a wide variety of useful applications. While natural fibers from trees and agricultural by-products are commonly available in many developing countries, the cellular structures of such natural fibers typically contain lignin, which is highly hydrophobic and is an obstacle to water absorption. Therefore, in their raw state, these natural fibers cannot be used to produce water absorbent materials.

One potential use for such water absorbent materials is the production of absorbent articles, such as fiber pads, sanitary pads and the like. Lack of access to affordable sanitary pads is a major barrier to education and employment in many developing countries, where millions of women and girls miss up to 50 days of school or work per year when they menstruate. Frequently, foreign-produced brands of sanitary pads are often too costly for these women and girls to obtain. For example, in Rwanda, 36% of girls who miss school do so because they do not have access to affordable sanitary pads. Alternatively, some women in developing countries resort to using rags, which are unhygienic, ineffective and potentially harmful.

Thus, there remains a need for a simple and inexpensive method of producing absorbent articles, using abundant natural fibers from agricultural by-products. The development of non-chemical processes to utilize these agricultural by-products would be especially desirable.

DISCLOSURE OF THE INVENTION

The present invention provides a process for producing a water-absorbent high-porosity fibrous matrix from mechanically processed lignocellulosic raw materials. The process involves wet mechanical processing of the lignocellulosic raw materials, drying the resulting fibers, and then dry mechanical processing the dried material to provide the high-porosity fibrous matrix.

The invention further provides absorbent articles, and more particularly water absorbent and retentive pads, made of mechanically-processed natural fibers having high levels of water absorbency and retention.

In one aspect, the invention provides a process for producing a water-absorbent high-porosity fibrous matrix comprising: (a) mechanically processing a lignocellulosic raw material with water; (b) drying the wet mechanically processed material to substantially remove the water content; and (c) dry-fluffing the dried material by mechanical processing to provide the high-porosity fibrous matrix.

In some embodiments, the process further comprises comminution of the lignocellulosic raw material into short fibers or small chips prior to mechanically processing in step (a). In certain embodiments, the process further comprises comminution of the lignocellulosic raw material into fiber lengths between about 0.1 centimeters and about 3 centimeters prior to mechanically processing in step (a).

In other embodiments, the process further comprises step (d), forming the high-porosity fibrous matrix into a water-absorbent and water-retentive pad.

In another aspect, the invention provides a water-absorbent and water-retentive pad comprising a high-porosity fibrous matrix prepared from lignocellulosic raw material by mechanical processing.

In preferred embodiments, the processes disclosed herein are purely mechanical. In certain embodiments the products of the mechanical process are subjected to bleaching.

In a further aspect, the invention provides a high-porosity fibrous matrix prepared from a mechanically processed lignocellulosic raw material, comprising lignocellulosic fibers having a cross sectional dimension in the range of about 10 to about 40 μm.

In another aspect, the invention provides a water-absorbent and water-retentive pad prepared according to one or more of the processes disclosed herein.

In yet another aspect, the invention provides a high-porosity fibrous matrix prepared according to one of the processes disclosed herein.

In some embodiments, the present invention is described herein by reference to the preparation of pads, and in particular sanitary or menstrual pads, as absorbent articles. Other absorbent articles, such as baby diapers, training pants, adult incontinence products, wound dressings and the like, can also be prepared using the processes and water-absorbent lignocellulosic fibrous materials of the present invention.

BRIEF DESCRIPTION OF THE DRAWINGS

FIG. 5 depicts the results of absorption F tests comparing the absorption results described in FIG. 4.

FIG. 7 depicts the results of retention F tests comparing the retention results of FIG. 6.

DETAILED DESCRIPTION

Figure 1:
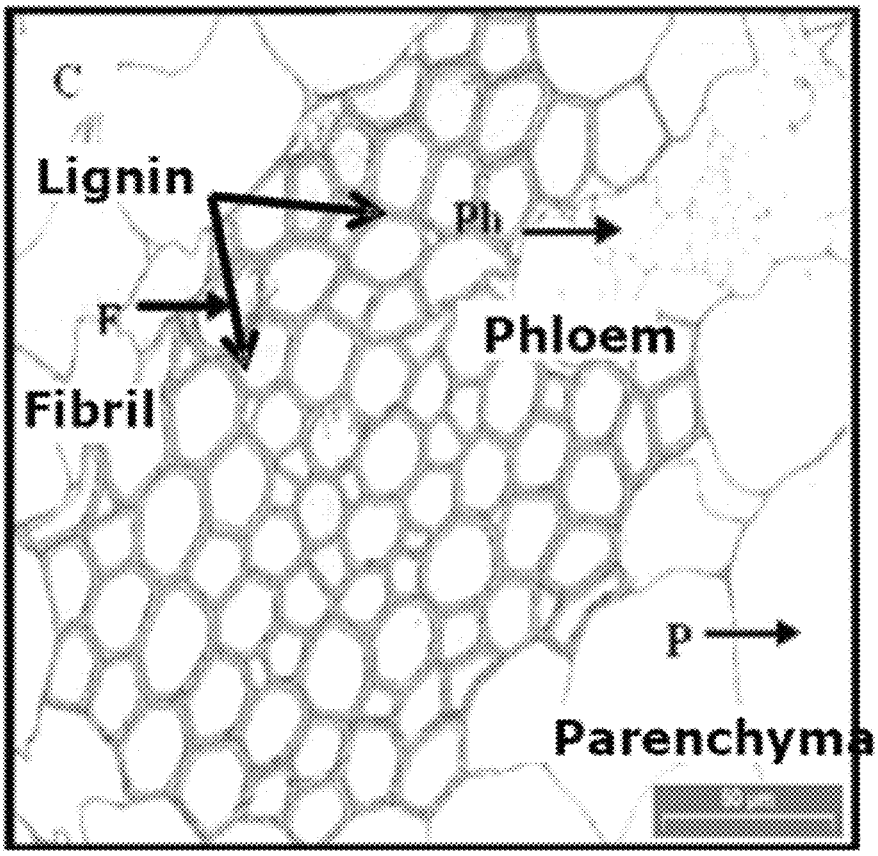
FIG. 1 depicts an exemplary structure of banana fibers.
Figure 2A:
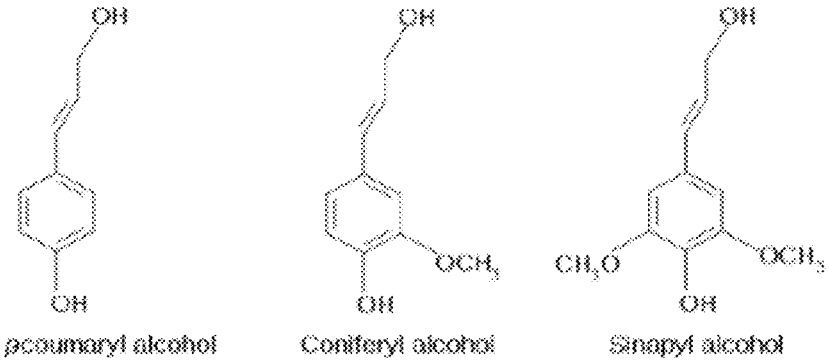
FIG. 2 shows three common monolignol monomers that make up the lignin heteropolymer (A) and shows the cross-linked structure of lignin (B).
Figure 2B:
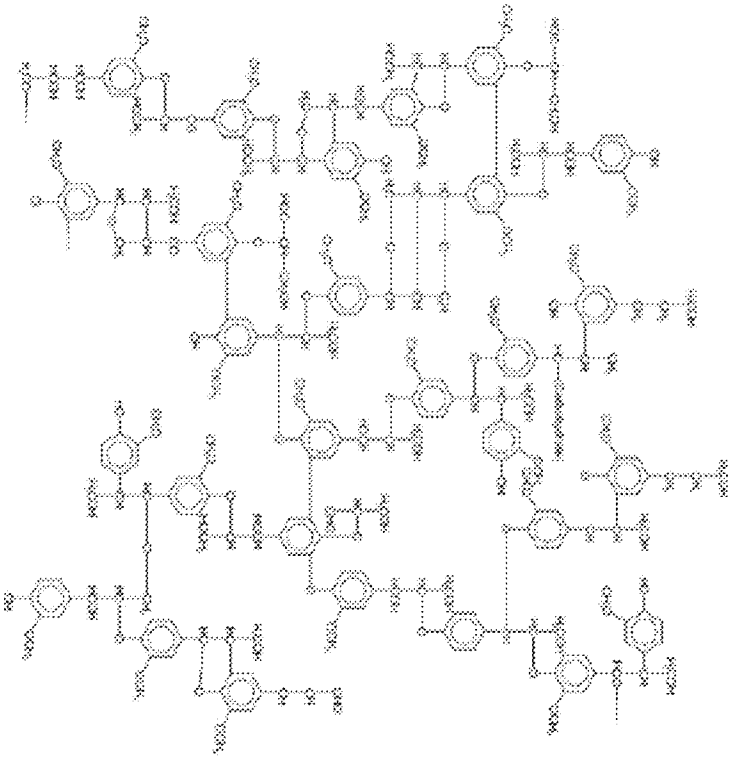

Lignocellulosic raw materials may be processed into a highly water-absorbing fibrous matrix by a process involving purely mechanical action. The lignocellulosic raw materials utilized in the present invention comprise fiber bundles, elemental fibers, or collections thereof.

The fiber bundles, elemental fibers, or collections thereof that make up the lignocellulosic raw materials are fractured primarily in the axial direction by mechanical processing, but some transverse cutting also occurs. This process reduces the size of the fibrous components and generates newly exposed surface areas that contain hydrophobic lignin, hydrophilic cellulose and/or other non-lignin materials. Because water uptake reflects a balance between fiber stiffness, fiber size and surface area, and hydrophilicity, higher water uptake is favored by the proper balance between lignified and cellulosic surface areas.

Without wishing to be bound by theory, it is believed that, on balance, the mechanically processed lignocellulosic materials described herein behave overall like a hydrophilic material and water is drawn into the interior by capillary action. High water absorption is thought to be aided by the presence of lignin, which provides fibers with compressive strength and stiffens the cell wall of the fibers. As a consequence, it is believed that these materials are able to resist internal capillary forces that tend to bring together hydrophilic surfaces within the matrix and would reduce void volume and water absorption were it not for the fibers stiffened by lignin. These materials are also able to resist internal compressive pressure better as a result of the presence of fiber stiffened by lignin.

In one aspect, the invention provides a process for producing a water-absorbent high-porosity fibrous matrix comprising: (a) mechanically processing a lignocellulosic raw material with water; (b) drying the wet mechanically processed material to substantially remove the water content; and (c) dry-fluffing the dried material by mechanical processing to provide the high-porosity fibrous matrix.

In some embodiments, the process further comprises comminution of the lignocellulosic raw material into small chips or small fiber lengths that can be taken into the wet mechanical processing step (a). In frequent embodiments, the process further comprises comminution of the lignocellulosic raw material into fiber lengths between about 0.1 cm and about 3 cm prior to mechanically processing in step (a).

In the wet mechanical processing step (a), the lignocellulosic raw materials are subjected to high impact and shearing forces that liberate elemental fibers from the fiber bundles and fracture the fibers in the presence of water, reducing their size and exposing new hydrophilic surface area. This fiber fracture can be accomplished with a variety of machines useful in preparation of mechanical pulp. In some embodiments, the wet mechanical processing step (a), comprises crushing, grinding, refining, beating, high speed blending, or a combination of these processes. In specific embodiments, the wet mechanical processing step (a) is performed using a blender. This process is sometimes referred to herein and in the examples as "wet blending" or "wet blended."

The wet-processed fiber mass is then dried to substantially remove the water content. The drying step (b) typically forms a dense mat of fibers that can be further processed, as described herein. The drying step (b) is performed at a temperature between ambient temperature and about 80° C. However, other temperatures above the freezing point of water may be appropriate under certain circumstances. For example, the drying step may be conducted at a temperature between about 10° C. and about 90° C., and is preferably conducted at a temperature between about 20° C. and about 80° C. In frequent embodiments, the drying step is conducted at 80° C.

In a further step (c), water uptake is further increased by dry mechanically processing the dried material to produce the high-porosity fibrous matrix that can be formed into a highly water-absorbent pad or other absorbent articles. This dry mechanical processing step (c) is frequently performed by dry-fluffing the dried fiber material. For example, the dry-fluffing step may include blending the dried material. In some embodiments, the dry-fluffing step (c) is performed using a blender. Other equipment similar to a blender may also be used to perform the dry-fluffing step. The dry-fluffing step further reduces the effective fiber density of the processed fibrous material. In some embodiments, the high-porosity fibrous matrix provided in the process comprises lignocellulosic fibers having a cross-sectional dimension in the range of about 10 to about 40 μm.

In other embodiments, the process further comprises step (d), forming the high-porosity fibrous matrix into a water-absorbent and water-retentive pad. Various techniques can be used to form the fibrous matrix into a suitable pad. For example, the material can be dry-pressed at an appropriate pressure to form a pad using a simple mechanical press. Alternatively, the fibrous material can be blown onto a solid surface to form a pad. Other techniques known to those of skill in the art may also be used to form pads or other absorbent articles. Such fiber pads may also be further modified, for example, to include an impermeable layer on one side, and/or a permeable layer on the other side. The pad, with or without these additional layers, may be encased in a permeable material or sleeve.

An intact sanitary pad includes a fiber pad as described herein, and further includes an impermeable bottom layer on one side and a permeable layer on the other side of the fiber pad that constitutes the intact sanitary pad. Fiber pads and sanitary pads produced according to the processes described herein have high levels of absorption and retention.

The processes described herein can be used with a variety of lignocellulosic raw materials. In some embodiments, the lignocellulosic raw material used in the process is selected from the group consisting of hardwoods, softwoods and agricultural byproducts. In other embodiments, the lignocellulosic raw material used in the process is an agricultural byproduct. In yet other embodiments, the lignocellulosic raw material used in the process is selected from the group consisting of agricultural byproducts of corn, wheat, rice, sorghum, barley, sugarcane, pineapple, banana, coconut and oil palm. In yet other embodiments, the lignocellulosic raw material used in the process comprises banana stem fibers.

The processes described herein produce an absorbent article, such as a water-absorbent and water-retentive pad. In some embodiments, the water-absorbent and water-retentive pad produced from the process has an absorption of about 20 $\text{grams}_{wet\ saturated\ pad}/\text{gram}_{dry\ fiber\ pad}$. In other embodiments, the water-absorbent and water-retentive pad produced from the process has a retention of about 8.5 $\text{grams}_{wet\ pressed\ pad}/\text{gram}_{dry\ fiber\ pad}$. In yet other embodiments, the water-absorbent and water-retentive pad produced from the process has an absorption of at least 9 $\text{grams}_{wet\ saturated\ pad}/\text{gram}_{dry\ fiber\ pad}$ and/or a retention of at least 8 $\text{grams}_{wet\ pressed\ pad}/\text{gram}_{dry\ fiber\ pad}$.

In another aspect, the invention provides an absorbent article comprising a high-porosity fibrous matrix prepared from lignocellulosic raw material by mechanical processing. In frequent embodiments, the absorbent article is a water-absorbent and water-retentive pad. In some such embodiments, the fiber pad is a sanitary pad. In some embodiments, the water-absorbent and water-retentive pad has an absorption of at least 9 $\text{grams}_{wet\ saturated\ pad}/\text{gram}_{dry\ fiber\ pad}$ and/or a retention of at least 8 $\text{grams}_{wet\ pressed\ pad}/\text{gram}_{dry\ fiber\ pad}$. In other embodiments, the absorbent article may include baby diapers, training pants, adult incontinence products, wound dressings and the like. Such absorbent articles can also be prepared using the processes and water-absorbent fibrous matrix of the present invention.

In specific embodiments, the natural lignocellulosic raw material of the pad may include banana stem fibers. In one embodiment, the effective fiber density of the pad and the processed fibrous matrix is lower than the effective fiber density of the raw material from which it is produced. The processed lignocellulosic fibers may provide an expanded structure to increase the void space between the cellulose-based fibrils.

In frequent embodiments, an absorbent article, such as the water-absorbent and water-retentive pad, is prepared from a high-porosity fibrous matrix comprising lignocellulosic fibers. In some embodiments, the water-absorbent and water-retentive pad is prepared from a high-porosity fibrous matrix comprising lignocellulosic fibers having a cross sectional dimension in the range of 10 to 40 μm. In other embodiments, the water-absorbent and water-retentive pad is prepared from lignocellulosic raw material selected from the group consisting of hardwoods, softwoods and agricultural byproducts. In other embodiments, the water-absorbent and water-retentive pad is prepared from lignocellulosic raw material selected from the group consisting of agricultural byproducts of corn, wheat, rice, sorghum, barley, sugarcane, pineapple, banana, coconut and oil palm. In frequent embodiments, the water-absorbent and water-retentive pad is prepared from lignocellulosic raw material comprising banana stem fibers.

Without wishing to be bound by theory, it is believed that the wicking action by which a pad imbibes water is favored by small pores or interstices defined by the internal surfaces within the pad, net hydrophilicity of these surfaces and the resistance to deformation of the fibers that comprise these surfaces. The equilibrium water uptake is determined by a balance between capillary forces that draw water into the material and the tendency of capillary forces to draw the surfaces closer together, thereby deforming the fibers. With fiber surfaces that are highly hydrophilic and fibers that are easily deformed, water is imbibed rapidly, but the structure partially collapses, thereby reducing the total volume and the volume of water taken up. With fibers that are more resistant to deformation, the structure does not collapse and may even expand, thereby leading to larger water uptake as occurred, for example, in Run 9 of Example 1 herein. In the process disclosed herein, hydrophilicity is increased by mechanical processing that fractures the fibers and exposes the hydrophilic surfaces on the interior of the fiber walls. This is accomplished without substantial removal of lignin. Although the presence of lignin reduces overall hydrophilicity of the material, retention of lignin maintains the strength and resistance to deformation of the fibers, thereby maintaining the volume of the structure and leading to increased water uptake.

Pads prepared according to the processes of the present invention may be characterized by their water absorption (A), retention (R), uptake (U), and water retention values (WRV), and pad-sinking properties, as further described herein.

In certain embodiments, the pad prepared according the process described herein has an absorption of at least 9 grams$_{wet\ saturated\ pad}$/gram$_{dry\ fiber\ pad}$. In other embodiments, the pad prepared according the process described herein has a retention of at least 8 grams$_{wet\ pressed\ pad}$/gram$_{dry\ fiber\ pad}$. In specific embodiments, the pad prepared according the process described herein has an absorption of at least 9 grams$_{wet\ saturated\ pad}$/gram$_{dry\ fiber\ pad}$ and a retention of at least 8 grams$_{wet\ pressed\ pad}$/gram$_{dry\ fiber\ pad}$. In certain embodiments, the pad prepared according the process described herein has an absorption of at least 12 grams$_{wet\ saturated\ pad}$/gram$_{dry\ fiber\ pad}$ and/or a retention of at least 9 grams$_{wet\ pressed\ pad}$/gram$_{dry\ fiber\ pad}$.

In a further aspect, the invention provides a high-porosity fibrous matrix prepared from a mechanically processed lignocellulosic raw material, comprising lignocellulosic fibers having a cross-sectional dimension in the range of about 10 to about 40 μm. The high-porosity fibrous matrix may be made of mechanically processed banana stem fibers, and have an absorption of at least 9 grams$_{wet\ saturated\ pad}$/gram$_{dry\ fiber\ pad}$ and a retention of at least 8 grams$_{wet\ pressed\ pad}$/gram$_{dry\ fiber\ pad}$.

Various embodiments are discussed below with reference to the figures and examples. However, those skilled in the art will readily appreciate that the detailed description given herein with respect to these figures and examples is for explanatory purposes as the subject matter extends beyond these limited embodiments.

In specific embodiments, the lignocellulosic raw materials used in the present invention are banana stem fibers. Banana stem fibers can be mechanically processed as described herein to produce a highly absorbent and water-retentive fiber matrix that can be fashioned into absorbent articles, such as pads. Banana is an example of a cash crop commonly available in developing countries. The banana stem by-products are typically discarded as waste. By-products from the agricultural production of bananas thus represent an excellent source of natural lignocellulosic fibers for producing absorbent articles such as fiber pads. It should be noted, however, that while reference is made to banana fibers as an exemplary embodiment throughout this disclosure, other natural fibers may similarly be utilized to produce a highly water-retentive fibrous matrix and absorbent articles and pads according to the processes described herein.

Banana fiber comes from the "trunk" of the banana tree. Dispersed throughout the tissue, there are bundles of strong fibers, which can be easily harvested. These fibers are composed of mostly cellulose and hemicellulose with some pectin and lignin. The cellulose and hemicellulose fiber are hydrophilic but they are covered and connected by the lignin-containing material, which strengthens the fiber and is hydrophobic. The outermost surface of the bundles is covered in non-lignin material, which is hydrophilic.

The process is believed to work by splitting the banana fiber bundles longitudinally into individual elemental fibers, or clusters of individual fibers, and then longitudinally fracturing individual fibers. The process is very robust and most parameters can be adjusted without affecting the performance of the processed fibrous product, which permits adjustment to accommodate a variety of constraints such as, in the case of wet blending, blending speed, fiber size and amount, blender size, or time limitations. If desirable, the product can be bleached during wet blending without great effect on performance.

In a specific embodiment, banana stem fibers were added to water and treated in a Waring® blender for five minutes at a speed of about 22,000 rpm. The fibers were then dried and were again treated in a Waring® blender without water to dry fluff the fibers. The original banana stem fibers had diameters averaging about 200 μm and were bundles of elementary fibers, each of which had cross sectional dimensions of 10-20 μm. The fully processed fibers had a wide size distribution, with a substantial fraction of the processed material having cross-sectional dimensions primarily in the range of about 10 to 40 μm. The processed fibers were pressed into a pad. In some embodiments, water uptake by the pad was about 21 grams$_{water\ absorbed}$/gram$_{dry\ fiber\ pad}$. After compression at a pressure of about 4.5 psi, the retention was about 8.5 grams$_{wet\ pressed\ pad}$/gram$_{dry\ fiber\ pad}$.

The fiber must be dried before it is fluffed. A preferred option for drying is to strain and spin the fiber to remove most of the water, then spread it out and allow it to dry in the low temperature ambient air. However, this method demands large amounts of time, space, and manpower to spread out and collect the material. If this is not feasible, drying the material at or below 80° C. is acceptable, but drying at 100° C. for 24 hours is not suitable. Although oven drying is quicker and requires less space and manpower, the oven will require more electric power than the other processing equipment thus increasing the overall cost of production. For the fluffing itself, no more than 20 seconds is necessary. Alternative drying methods can be envisaged, such as use of a washer/dryer to spin and dry the fibers. It will be understood that other drying regimes can be conceived of without departing from the essence of the invention.

As discussed herein, it has been hypothesized that the success of the process results from the exposure of more cellulosic surface area as the fiber bundles and elemental fibers are fractured, while maintaining lignified regions of fibers for structural support such that the fibrous matrix, or a pad thereof, does not collapse when wet. Scanning electron and optical microscopy were used to validate this hypothesis.

Figure 10:
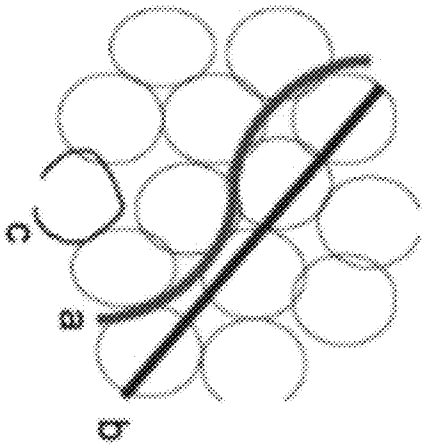
FIG. 10 shows longitudinal fracturing possibilities of fiber bundles on mechanical processing. The fiber bundle may (a) fracture along the interface of the fiber, or (b) through the fibers. The inner fiber surface is exposed when (b) occurs or when (c) individual tubes are split open into ribbons.

As shown graphically in FIG. 10, when the fiber bundle is fractured longitudinally, the process separates individual bundles longitudinally into smaller bundles of fewer fibers. Fracturing can occur along the interface of the elemental fibers, leaving each individual tube structure intact, as in FIG. 10(A). When this occurs, the lignified surfaces (middle lamella) are further exposed. Second, the fracturing can occur through elemental fibers as in FIG. 10(B), in which case the inner, cellulosic surface of the fibers are exposed. Alternatively, the inner surface of the fiber could also be exposed when individual fiber tubes are broken open longitudinally into ribbons, as in FIG. 10(C). Each of these fracturing possibilities is evident in the SEM images, but it is unclear which of these possibilities is predominant and when in the course of processing each occurs.

The following examples are intended to illustrate but not to limit the invention.

EXAMPLE 1

General Mechanical Processing Protocol

Figure 3:
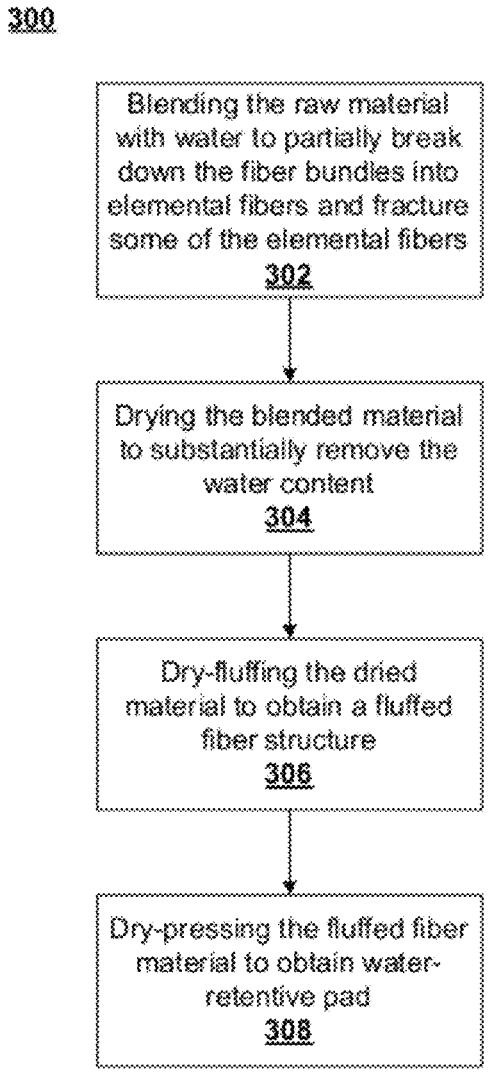
FIG. 3 describes an exemplary process for producing a highly water-absorbent and water-retentive fiber matrix from lignocellulosic raw materials.

FIG. 3 depicts an exemplary process 300 of producing a highly water-absorbent and water-retentive fibrous matrix and pads from raw banana fibers. The process 300 includes a wet blending step, 302, wherein the lignocellulosic raw material is blended and mechanically processed with water to partially break down the fiber bundles into elemental fibers and/or smaller clusters thereof.

For example, in the wet blending step, approximately 6 g of raw material, cut into pieces of 1-2 cm in length, and 1½ cups of water was placed in a blender container sealed with PARAFILM™ and the container lid to avoid leakage. The fiber and water mix was then blended together at highest speed for approximately 5 minutes. An example of a blender used for this step was a model 7012G, from Waring®, Torrington, Conn., which operates at 22,000 rpm at the highest setting. The blended fiber was then vacuum filtered using a Hirsch funnel with filter paper to separate the solid fiber material from the slurry. The solid material obtained in this process included a fiber structure in which at least some of the fiber bundles in the raw material had been fractured into elemental fibers and small clusters thereof.

Process 300 further includes a drying step, 304, of drying the wet blended material to substantially remove the water content. In this step, the wet blended material may be dried at, for example, room temperature over a period of 24 hours. Alternatively, the blended material may be dried up to about 90° C. until the water content has been substantially removed, without affecting the structure of the processed fiber.

After the drying step, 304, the dried material is dry-blended (i.e., dry-fluffed) in step 306 to obtain a fluffed fiber structure. The dry-fluffing treatment may involve using the same blender as used in the wet blending step, to further process fibers without the presence of water.

For example, approximately 6 g of dry fiber was placed in the container of the same blender used in blending step 302 and the blender was set at the highest speed for 10-20 seconds to break up the fiber clumps. The fluffing step caused the fiber structure to fracture even further, resulting in a dry fiber material that included predominantly elemental fibers or small clusters of approximately 10 to 40 μm in diameter, with some larger bundles of approximately 200 μm in diameter.

The process 300 may further include a step 308 of dry-pressing the fluffed material to produce highly-absorbent and water-retentive pads.

To measure the performance of the fibers, small disk pads were prepared and used for performance testing. The small disk test pads were made by pressing processed fibers. One gram of the processed fiber was carefully weighed ($m_{dry}$) and placed inside a die-punch with a 2-inch inner diameter. The die-punch lid, weighing 1.1 pounds, was placed on the fibers for approximately 1 min to press the fibers into a pad under a pressure of approximately 4.5 psig.

The pad produced according to the process described above had high levels of water absorption and retention. Various methods of producing pads were explored and the above-described method resulted in the highest absorption and retention levels.

Water Absorption and Retention

Water can be retained chemically through adsorption onto the fiber bundles and elemental fibers, as well as in the interstices between fibers.

The void space in a pad, which can be expressed by void fraction ϕ, is defined as:

$$\phi = \frac{V_{Void}}{V_{Total}} \tag{1}$$

where V represents the volume in a wet pad under steady state conditions. The void volume is a measure of how much total water is retained in the fiber interstices.

The absorption of a pad (A) may be defined as the ratio between its wet mass after allowing it to absorb water ($m_{sat}$) and its dry pad mass ($m_{dry}$):

$$A = \frac{m_{sat}}{m_{dry}} \tag{2}$$

Assuming that all of the void volume (interstitial space) in the test pad is filled with water and that the volume of the pad does not change with water uptake, the void space (i.e., the space not occupied by fibers) in a pad is related to the amount of water that is absorbed by a mass of fiber according to Equation 3:

$$\phi = \frac{A - 1}{\frac{\rho_w}{\rho_f} + A - 1} \tag{3}$$

where ϕ is the void fraction, $m_{wet}$ and $m_{dry}$ are the wet and dry masses of a given pad; $\rho_w$ and $\rho_f$ are the densities of the water and fiber, respectively; and A is the absorption.

This equation can be rearranged to be explicit in void fraction, $$A = \frac{\frac{\rho_w}{\rho_f}\phi - \phi + 1}{1 - \phi} \tag{4}$$

As void fraction, ϕ, increases and approaches 1.0, absorption increases and a small change in void fraction (which corresponds to a large relative change in fiber density) causes a large change in absorption. The void fraction of a dry pad in air as originally prepared may increase, stay the same, or decrease as it absorbs water and becomes saturated.

A conservative estimate of absorption is evaluated by having gravity drain the water from the pads as they are held on an edge. For example, weighing boats containing the wet pads may be tipped on edge vertically for thirty seconds or so while the excess water dripped into a container for disposal. The pad may then be removed from the boat and held on its edge vertically for another thirty seconds. The drained pad may then be replaced in the weighing boat for a measurement of its water-saturated mass.

Once absorption is determined, the soaked pad is removed from the weighing boat, placed under the same die-punch used for pad-making, and pressed for sixty seconds with a 13 lb block and a 1.1 lb die-punch lid, to give a pressure of 4.5 psig. The resulting pad is then carefully removed from the punch using tweezers and placed back into the dried weighing boat for another weight measurement.

The retention of a pad (R) may be defined as the ratio of its wet mass retained after compression ($m_{ret}$) to its dry pad mass ($m_{dry}$):

$$R = \frac{m_{ret}}{m_{dry}} \tag{5}$$

Comparative Chemical Processes

Three different chemical treatments for processing natural banana fibers were tested for comparison to the purely mechanical process disclosed herein. These chemical treatments included: 2% (w/v) sodium carbonate, 8% (w/v) sodium hydroxide (an analogue of the commercial soda process), and Kraft solution (20% sulphidity and 25% effective alkali strength).

Chemical treatments were performed on fiber at different combinations of elevated temperature and pressure. For each reaction, approximately 10.0 g of the fiber, cut into pieces of 1-2 cm in length, was placed into a 2 L glass beaker. The reactant chemicals were then placed in a 1 L volumetric flask that was filled to the volumetric mark with tap water. The chemicals were allowed to dissolve under agitation by a magnetic stirring bar at 40° C. until the solution was no longer turbid. Using solid reactants, sodium carbonate, sodium hydroxide, and Kraft solutions were made using 20.0 g of dry sodium carbonate dibasic, 80.0 g of dry sodium hydroxide, 56.6 g of sodium sulfide nonahydrate, and 20.0 g of sodium hydroxide, respectively. For each experiment, 800 mL of the appropriate reaction solution was added to the 10 g of the fiber in the 2 L beaker.

Alternative Mechanical Processes

In addition to the process 300 and the control chemical processes described above, several alternative mechanical processes were examined, as well as several combinations of chemical/mechanical processes. For example, a steam explosion ("STEX") procedure was applied, in which 10 g of the fiber material were placed in 2 L beakers and immersed in one of the following aqueous solutions: 2% (w/v) sodium hydroxide, 8% (w/v) sodium hydroxide, or 2% (w/v) sodium carbonate. The solutions were made using the process described above for chemical treatments. The 2 L beaker with fiber and 800 mL of solution was placed in a laboratory autoclave (SR-24A, Consolidated, Boston, Mass.) set to a drying cycle that automatically carried out the steam explosion. The autoclave had an internal pressure of 30-35 psig and an internal temperature of 140-145° C. for one hour, after which the pressure was released at the maximum allowable speed for the specific autoclave.

Furthermore, as an alternative to using a blender to wet-blend and dry-fluff the fiber material, a laboratory food processor (WCG75, Waring®, Torrington, Conn.) was used to treat the fibers, which is referred to herein as the "food processing" treatment. In this process, 3 g of dry fiber were placed into the processor container, which was then turned on for five minutes.

Yet another alternative method used a hand milling ("milling") mechanical treatment via a hand-cranked grain mill (VKP1012, Victorio, Orem, Utah) designed to grind raw grain. In this process, fibers were inserted into the hopper of the grain mill, which was cranked by hand to shred the fiber into a collection container. The grain mill had to be closely monitored to ensure that it was actually grinding the fiber and not allowing fiber to pass through untouched, and this method was not pursued.

Terminology for Example 1

The results of the pads produced according to embodiments described herein and the comparative examples are discussed with reference to controls, one of which is a negative control and two of which are positive controls. The negative control discussed herein is untreated raw banana fiber cut into pieces 1-2 cm in length. The first positive control is fiber obtained from a wood pulp-based pad available in Rwanda, which is sometimes referred to herein as the "Rwandan pad." The second positive control is fiber taken from an ALWAYS™ Maxi Overnight pad manufactured by Proctor & Gamble, which is widely-used in the United States and is sometimes referred to herein as the "American pad."

For conditions referred to herein as "tabletop" conditions, the solution-fiber mixture was heated to 90° C. on a laboratory hot plate and agitated using a TEFLON™ coated magnetic stirring bar at atmospheric pressure.

For "pressure cooker" conditions, the solution-fiber mixture was placed in a domestic pressure cooker that was heated to 110° C. and pressurized to 10 psig, again using a TEFLON™ magnetic stirring bar to create agitation. The steam was vented from the pressure cooker after the allotted reaction time.

All heat settings were chosen such that the reaction solution would stabilize at approximately the reaction temperature, 90° C. and 110° C. for tabletop and pressure cooker, respectively. All chemical reactions were performed at least once under tabletop conditions. Only the Kraft solution reactions were performed in the pressure cooker.

The following naming conventions are used to describe the combination of treatments that were performed on the fiber material. Each specific treatment or condition has an assigned abbreviation. The order of abbreviations in each combination treatment title is: (1) pre-mechanical treatment, (2) concentration of chemical for treatment, (3) chemical used for treatment, (4) conditions for treatment, (5) first post-mechanical treatment and (6) second post-mechanical treatment. These naming conventions are displayed in Table 1.

TABLE 1

Naming conventions for data presentation

| Category | Abbreviation | Description |
|---|---|---|
| Control | Raw | Raw fiber |
| | RW | Rwandan pad |
| | US | American pad |
| (a) Pre-mechanical | B | Wet blended |
| | M | Milled |
| (b) Concentration | 2% | 2% (w/v) chemical |
| | 8% | 8% (w/v) chemical |
| (c) Chemical | OH | Sodium hydroxide |
| | CO3 | Sodium carbonate |
| | K | Kraft solution |

TABLE 1-continued

| Naming conventions for data presentation | | |
|---|---|---|
| Category | Abbreviation | Description |
| (d) Conditions | TT | Tabletop (90° C., 0 psig) |
| | SE | Steam explosion (140° C., 30 psig) |
| | 8 H | 8 hour reaction time |
| (e) Post-mechanical 1 | B | Wet blended |
| (f) Post-mechanical 2 | F | Fluffed |

Experimental Results

Numerical data for the various treatment methods are presented in Table 2 below. Processing details are summarized for each batch of treated fiber. The processed banana fiber pads are compared to the three controls. Runs identified in Table 2 as "Dry Pressed (heavy)" refer to pads pressed with a 13.5 lb block plus a 1.1 lb die-punch lid, while "Dry Pressed (light)" refer to pads pressed with only the 1.1 lb die-punch lid. Data are reported as mean±standard deviation. Coefficient of variation (COV) for absorption data (%) are provided in Table 2 to measure the degree of variation relative to the absolute amount of absorption and is defined by:

$$\text{Absorption } COV\ (\%) = \frac{\text{Absorption Standard Deviation}}{\text{Absorption Mean}} \cdot 100 \quad (6)$$

TABLE 2

Table 2: Mechanical and chemical treatment details for all data and controls.

| | Treatment Category | | |
|---|---|---|---|
| | Control | Control | Control |
| Title | Raw | RW | US |
| Run Number | 1 | 2 | 3 |
| Pre-mechanical | | | |
| Chemical | | | |
| Conditions | | | |
| Post-mechanical 1 | | | |
| Post-mechanical 2 | | | |
| Pad-making | Wet Pressed | Wet Pressed | Dry Pressed (heavy) |
| Absorption | 7.8 ± 0.5 | 11.2 ± 0.6 | 14 ± 2 |
| Retention | 7.4 ± 0.4 | 9 ± 1 | 8.4 ± 0.2 |
| Absorption COV % | 6.4 | 5.3 | 14.8 |
| Sample Number | 6 | 6 | 5 |

| | Treatment Category | | |
|---|---|---|---|
| | Individual Chemical | Individual Chemical | Individual Chemical |
| Title | 8% OH TT | 2% $CO_3$ TT | K TT |
| Run Number | 4 | 5 | 6 |
| Pre-mechanical | | | |
| Chemical | 8% NaOH | 2% $Na_2CO_3$ | Kraft |
| Conditions | 90 C., 0 psig, 1 hr | 90 C., 0 psig, 1 hr | 90 C., 0 psig, 1 hr |
| Post-mechanical 1 | | | |
| Post-mechanical 2 | | | |
| Pad-making | Wet Pressed | Wet Pressed | Wet Pressed |
| Absorption | 9.5 ± 0.4 | 10.1 ± 0.5 | 7.5 ± 0.4 |
| Retention | 7.9 ± 0.4 | 8.6 ± 0.6 | 7.0 ± 0.3 |
| Absorption COV % | 4.0 | 5.4 | 5.4 |
| Sample Number | 10 | 17 | 8 |

TABLE 2-continued

Table 2: Mechanical and chemical treatment details for all data and controls.

| | Treatment Category | | |
|---|---|---|---|
| | Individual Mechanical | Individual Mechanical | Individual Mechanical |
| Title | M | B | B F |
| Run Number | 7 | 8 | 9 |
| Pre-mechanical | Milled | Wet Blended | Wet Blended |
| Chemical | | | |
| Conditions | | | |
| Post-mechanical 1 | | | Fluffed |
| Post-mechanical 2 | | | |
| Pad-making | Wet Pressed | Wet Pressed | Dry Pressed (light) |
| Absorption | 9.4 ± 1.0 | 10.0 ± 0.6 | 21 ± 2 |
| Retention | 8.6 ± 0.9 | 8.7 ± 0.4 | 9.6 ± 1.5 |
| Absorption COV % | 11.0 | 5.8 | 9.6 |
| Sample Number | 6 | 8 | 10 |

| | Treatment Category | |
|---|---|---|
| | STEX Combo | STEX Combo |
| Title | 2% OH SE | 8% OH SE |
| Run Number | 10 | 11 |
| Pre-mechanical | | |
| Chemical | 2% NaOH | 8% NaOH |
| Conditions | 140 C., 30 psig, 1 hr | 140 C., 30 psig, 1 hr |
| Post-mechanical 1 | | |
| Post-mechanical 2 | | |
| Pad-making | Wet Pressed | Wet Pressed |
| Absorption | 8.9 ± 0.3 | 8.8 ± 0.5 |
| Retention | 7.2 ± 0.3 | 7.0 ± 0.3 |
| Absorption COV % | 3.6 | 5.8 |
| Sample Number | 12 | 10 |
| Title | 2% CO3 SE | M 2% OH SE |
| Run Number | 12 | 13 |
| Pre-mechanical | | Milled |
| Chemical | 2% $Na_2CO_3$ | 2% NaOH |
| Conditions | 140 C., 30 psig, 1 hr | 140 C., 30 psig, 1 hr |
| Post-mechanical 1 | | |
| Post-mechanical 2 | | |
| Pad-making | Wet Pressed | Wet Pressed |
| Absorption | 9.1 ± 0.4 | 8.6 ± 0.5 |
| Retention | 7.6 ± 0.5 | 7.7 ± 0.4 |
| Absorption COV % | 4.0 | 5.3 |
| Sample Number | 10 | 11 |

| | Treatment Category | |
|---|---|---|
| | Chemical + Post-mechanical | Chemical + Post-mechanical |
| Title | 8% OH TT B | 8% OH TT B F |
| Run Number | 14 | 15 |
| Pre-mechanical | | |
| Chemical | 8% NaOH | 8% NaOH |
| Conditions | 90 C., 0 psig, 1 hr | 90 C., 0 psig, 1 hr |
| Post-mechanical 1 | Wet Blended | Wet Blended |
| Post-mechanical 2 | | Fluffed |
| Pad-making | Wet Pressed | Dry Pressed (heavy) |
| Absorption | 5.8 ± 0.5 | 12 ± 2 |
| Retention | 5.5 ± 0.4 | 9 ± 2 |
| Absorption COV % | 8.2 | 17.8 |
| Sample Number | 6 | 4 |

| | Treatment Category | |
|---|---|---|
| | Pre-mech + Chemical + Post-mech | Pre-mech + Chemical + Post-mech |
| Title | B 8% OH TT B F | M 2% $CO_3$ TT B F |
| Run Number | 16 | 17 |
| Pre-mechanical | Wet Blended | Milled |
| Chemical | 8% NaOH | 2% $Na_2CO_3$ |
| Conditions | 90 C., 0 psig, 1 hr | 90 C., 0 psig, 1 hr |
| Post-mechanical 1 | Wet Blended | Wet Blended |
| Post-mechanical 2 | Fluffed | Fluffed |

TABLE 2-continued

Table 2: Mechanical and chemical treatment details for all data and controls.

| | | |
|---|---|---|
| Pad-making | Dry Pressed (heavy) | Dry Pressed (heavy) |
| Absorption | 14 ± 1 | 6.0 ± 0.4 |
| Retention | 8.9 ± 0.2 | 5.0 ± 0.2 |
| Absorption COV % | 7.6 | 6.3 |
| Sample Number | 4 | 6 |
| Title | B 8% OH TT 8 h B F | M 8% OH TT B F |
| Run Number | 18 | 19 |
| Pre-mechanical | Wet Blended | Milled |
| Chemical | 8% NaOH | 8% NaOH |
| Conditions | 90 C., 0 psig, 8 hr | 90 C., 0 psig, 1 hr |
| Post-mechanical 1 | Wet Blended | Wet Blended |
| Post-mechanical 2 | Fluffed | Fluffed |
| Pad-making | Dry Pressed (light) | Dry Pressed (light) |
| Absorption | 19.6 ± 0.8 | 17 ± 1 |
| Retention | 9.4 ± 0.4 | 9.0 ± 0.4 |
| Absorption COV % | 4.1 | 7.2 |
| Sample Number | 5 | 6 |

| | Treatment Category | |
|---|---|---|
| | Unsuccessful | Unsuccessful |
| Title | B 2% CO3 TT B F | B 2% CO3 TT 8 h B F |
| Run Number | 20 | 21 |
| Pre-mechanical | Wet Blended | Wet Blended |
| Chemical | 2% $Na_2CO_3$ | 2% $Na_2CO_3$ |
| Conditions | 90 C., 0 psig, 1 hr | 90 C., 0 psig. 8 hr |
| Post-mechanical 1 | Wet Blended | Wet Blended |
| Post-mechanical 2 | Fluffed | Fluffed |
| Pad-making | Dry Pressed (heavy) | Dry Pressed (heavy) |
| Problem | Would not post-blend | Did not form pads |
| Title | FP | |
| Run Number | 22 | |
| Pre-mechanical | Food Processed | |
| Pad-making | Wet Pressed | |
| Problem | Did not form pads | |

From Table 2, the two processes that produced the highest absorption values were the treatments of Run 9 and Run 18. In Run 9, raw fiber was treated under tabletop (TT) conditions by wet blending (i.e., wet mechanical processing in a blender), drying and dry fluffing without using a chemical treatment. In Run 18, the fiber was treated under tabletop (TT) conditions with sodium hydroxide for 8 hours, followed by wet blending, drying and dry fluffing. These runs had absorption values of 21 and 19.6, respectively, which were both significantly better than the absorption value of 14 for commercially available American pads (Run 3).

Pads made from fibers that were only wet-blended (i.e., Run 8) had an absorption value of approximately 10, as did milled fiber pads (Run 7). These results are statistically similar to the top individual chemical treatments.

Figure 4:
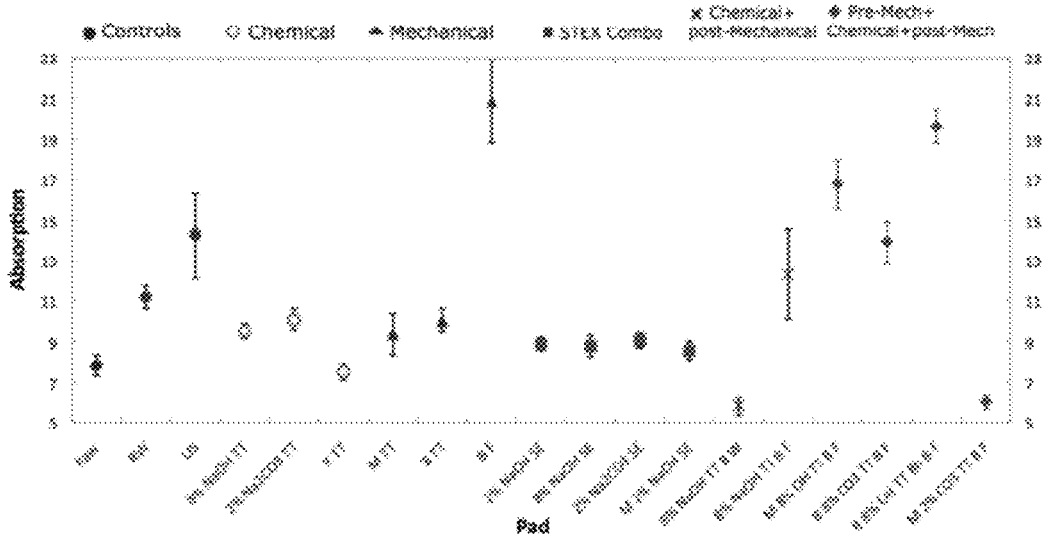
FIG. 4 describes the results of absorption testing on exemplary pads prepared from banana stem fibers mechanically processed using the process disclosed herein, as well as comparative examples.

FIG. 4 depicts the results of absorption tests for all the controls and treated banana fiber pads. Mean absorption values with standard deviation error bars are displayed. The results are divided into six categories: controls, individual chemical treatments, individual mechanical treatments, STEX combo treatments, chemical and post-mechanical treatments in series, and pre-mechanical, chemical and post-mechanical treatments in series.

FIG. 5 similarly depicts the results of an absorption F test comparing all possible pairs of data set to determine statistically significant differences. This figure uses the F test to statistically compare the treatment categories at 95% confidence. In FIGS. 4 and 5, mechanical treatment of the fiber involving blending, drying, and dry-fluffing of the fiber material produced the best absorption as compared to all other comparative examples.

Figure 6:
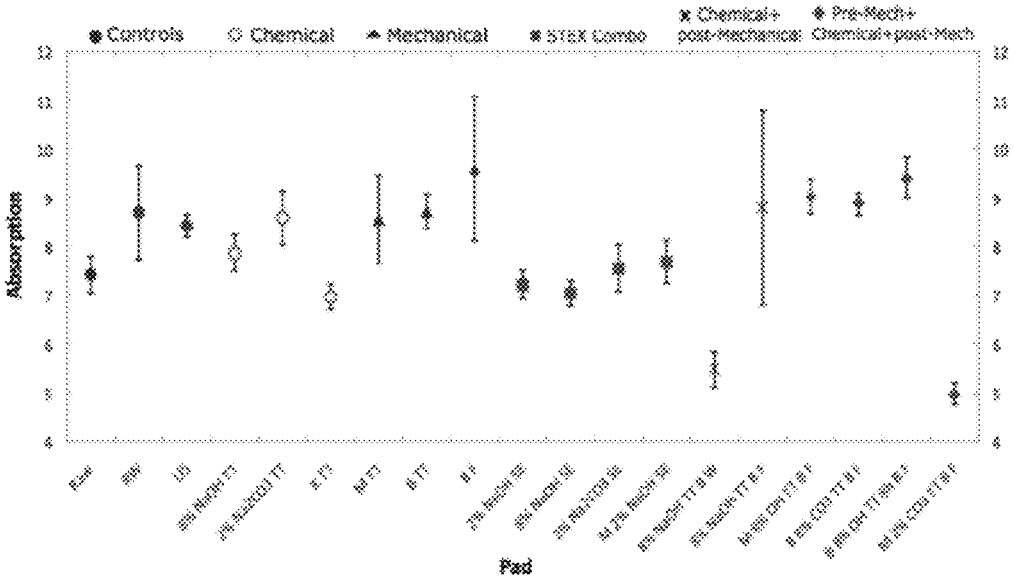
FIG. 6 depicts the results of retention testing conducted on exemplary pads prepared from banana stem fibers mechanically processed using the process disclosed herein, as well as comparative examples.

FIG. 6 depicts the results of retention tests for all the controls and treated banana fiber pads. Mean retention values with standard deviation error bars are displayed. The results are divided into six categories: controls, individual chemical treatments, individual mechanical treatments, STEX combo treatments, chemical and post-mechanical treatments in series, and pre-mechanical, chemical and post-mechanical treatments in series.

FIG. 7 similarly depicts the results of a retention F test comparing all possible pairs of data set to determine statistically significant differences. This figure uses the F test to statistically compare the treatment categories at 95% confidence. In FIGS. 6 and 7, mechanical treatment of the fiber involving blending, drying, and dry-fluffing of the fiber material produced retention levels better than or at least equivalent to other comparative examples.

Fiber Structure

An estimate of average fiber diameter is provided in Table 3 using digital photomicrographs of the fiber material resulting from the tests described above. Using the GNU Image Manipulation Program a 50 μm by 50 μm grid was created from the scale and superimposed over the images. Six cells were selected at random, and the fiber diameter of every fiber that passed through that cell was estimated.

The term "effective fiber density" used herein refers to a qualitative evaluation of the number of fibers in a physical space. High effective fiber density means that a large number of fibers are clumped together in a small space, while low effective fiber density corresponds to fibers that are spread out over a larger space.

Figure 8:
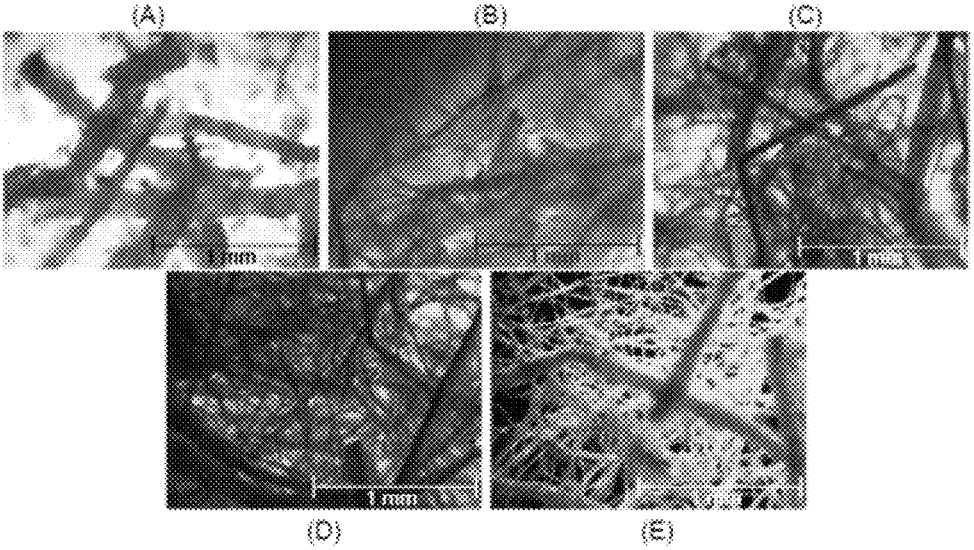
FIG. 8 depicts examples of the fiber structures treated with mechanical processing steps, including: hand milling (Run 7) (A); blending (Run 87) (B); blending and fluffing (Run 9) (C), (D) and (E).

FIG. 8 depicts examples of the fiber structures treated with individual mechanical treatments, as described herein. FIG. 8(A) depicts hand-milled banana fibers (Run 7), FIG. 8(B) depicts blended banana fibers (Run 8), and FIGS. 8(C), (D) and (E) depict blended and fluffed banana fibers (Run 9). When fluffed, the observed lower bound of fiber diameter decreased from 30 μm for blended fiber to 10 μm for blended fluffed fiber. As shown in Table 3 and FIGS. 8(A) and (E), Run 9 resulted in banana fibers that included elemental fibers and clusters thereof of approximately 10 to 40 μm in diameter (cross-sectional dimension) as well as larger fiber bundles up to approximately 200 μm in diameter, providing an open structure to hold the fibers together. It is thought that the smaller fibers provide increased hydrophilicity to the fiber matrix by exposing interior hydrophilic surfaces.

TABLE 3

Table 3 - Fiber diameters from photomicrographs

| Treatment Category | Fiber Diameter (μm) |
|---|---|
| Control | |
| Raw Banana Fiber (1) | 150-250 |
| Rwandan Pad (2) | 20-30 |
| American Pad (3) | 20-30 |
| American Pad Dark Field (3) | 10-30 |
| Individual Chemical | |
| 8% NaOH 1 hr TT (4) | 25-150 |
| 2% $Na_2CO_3$ 1 hr TT (5) | 50-150 |
| Kraft (6) | 20-30 |
| Individual Mechanical | |
| Milled (7) | 50-200 |
| Blended (8) | 30-50 |
| Blended Fluff (9) | 10-200 (wide variation) |
| Blended Fluff Dark Field 1 (9) | 10-100 (wide variation) |
| Blended Fluff Dark Field 2 (9) | 20-100 (wide variation) |

TABLE 3-continued

Table 3 - Fiber diameters from photomicrographs

| Treatment Category | Fiber Diameter (μm) |
|---|---|
| STEX Combo | |
| 2% NaOH SE (10) | 50-150 |
| 8% NaOH SE (11) | 40-100 |
| 2% $Na_2CO_3$SE (12) | 70-150 |
| Milled 2% NaOH SE (13) | 50-100 |
| Chemical + Post Mech | |
| 8% NaOH 1 hr + Blend (14) | 20-30 |
| 8% NaOH 1 hr + Blend + Fluff (15) | 20 |
| Pre-Mech + Chemical + Post Mech | |
| Blend + 8% NaOH 1 hr TT + Blend + Fluff (16) | 10-20 |
| Mill + 2% $Na_2CO_3$ 1 hr TT + Blend + Fluff (17) | 20-30 |
| Blend + 8% NaOH 8 hr TT + Blend + Fluff (18) | 10-20 |
| Blend + 8% NaOH 8 hr TT + Blend + Fluff Dark Field (18) | 10-20 |
| Mill + 8% NaOH 1 hr TT + Blend + Fluff (19) | 10-30 |
| Mill + 8% NaOH 1 hr TT + Blend + Fluff Dark Field (19) | 10-30 |
| Unsuccessful | |
| Blend + 2% $Na_2CO_3$ 1 hr TT + Blend + Fluff (20) | 20-30 |
| Blend + 2% $Na_2CO_3$ 8 hr TT + Blend + Fluff (21) | 20-30 |
| Food Processed (22) | 70-200 |

Figure 9A:
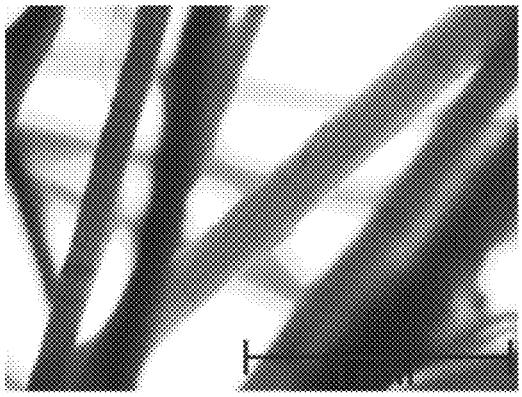
FIG. 9 depicts comparative examples of the fiber structures of untreated raw fibers (A), fibers in a conventional "American" pad (B), and chemically treated fibers (Run 19) (C).
Figure 9B:
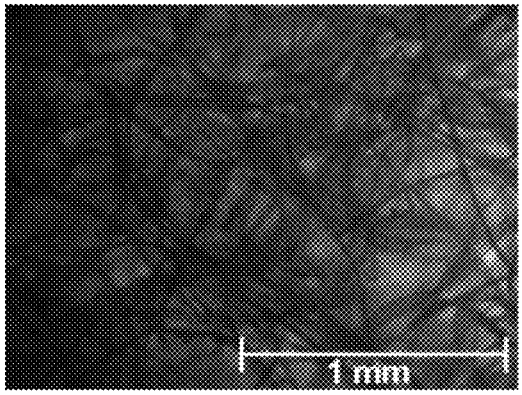
Figure 9C:
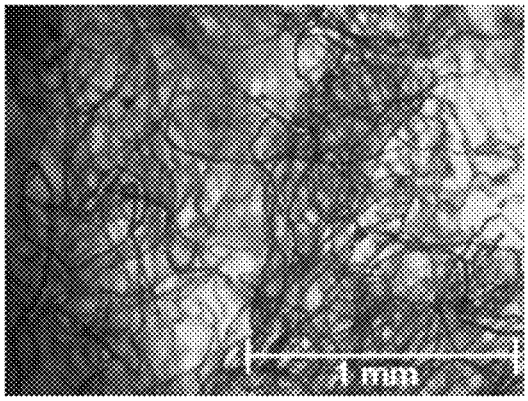

FIGS. 9(A), (B), and (C) depict, respectively, untreated raw fibers (control), fibers in the American pad (control), and an example of chemically treated fiber (Run 18). Unlike FIGS. 8(A)-(C), the raw fibers in the chemically treated material in FIG. 9(C) were approximately 200 μm in diameter, while the fibers from the American pad, as well as the fibers that were both chemically and mechanically treated were approximately 10-20 μm in diameter. None of the other runs resulted in fibers that included both elemental fibers and small groups thereof of approximately 10 to 40 μm as well as original fiber bundles of approximately 200 μm in diameter.

The results of color and texture evaluation of the different fibers are displayed in Table 4. Two measures of texture were used herein: pad and fiber. Pad texture refers to the compressibility of the pad in the vertical direction and the amenability of the pad to folding. Soft pads are both compressible and easily folded, while brittle pads are neither compressible nor easily folded. The other type of texture measurement, i.e., the fiber texture, is a measure of how each individual fiber responds to compression. Stiff fibers are sharp and do not bend easily under compression, while flexible fibers immediately collapse under compression. In order for a pad to be acceptable for skin contact, the pad has to be soft and the fibers have to be flexible.

TABLE 4

Table 4 - Fiber texture and color evaluation

| Treatment | Run # | Color | Pad Texture | Fiber Texture | Approval for Skin Contact? |
|---|---|---|---|---|---|
| Raw | 1 | Yellow | Soft | Stiff | No |
| RW | 2 | White | Soft | Flexible | Yes |
| US | 3 | White | Soft | Flexible | Yes |
| 8% OH TT | 4 | Light Yellow | Brittle | Flexible | No |
| 2% $CO_3$ TT | 5 | Light Brown | Brittle | Stiff | No |
| K TT | 6 | Brown | Brittle | Stiff | No |

TABLE 4-continued

Table 4 - Fiber texture and color evaluation

| Treatment | Run # | Color | Pad Texture | Fiber Texture | Approval for Skin Contact? |
|---|---|---|---|---|---|
| M | 7 | Yellow | Soft | Flexible | Yes |
| B | 8 | Yellow | Soft | Flexible | Yes |
| B F | 9 | Light Yellow | Soft | Flexible | Yes |
| 2% OH SE | 10 | Yellow | Brittle | Stiff | No |
| 8% OH SE | 11 | Yellow | Brittle | Stiff | No |
| 2% $CO_3$ SE | 12 | Light Brown | Brittle | Stiff | No |
| M 2% OH SE | 13 | Yellow | Brittle | Stiff | No |
| 8% OH TT B | 14 | Yellow | Brittle | Stiff | No |
| 8% OH TT B F | 15 | Light Yellow | Soft | Flexible | Yes |
| B 8% OH TT B F | 16 | Light Yellow | Soft | Flexible | Yes |
| M 8% OH TT B F | 17 | Light Yellow | Soft | Flexible | Yes |
| B 8% OH TT 8 h B F | 18 | Yellow-White | Soft | Flexible | Yes |
| B 8% OH TT 1 h B F | 19 | Light Brown | Brittle | Stiff | No |

Run 9 and Run 18 produced the best absorption and retention combination. However, Run 18 required eight hours of reaction with 8% sodium hydroxide followed by blending and fluffing. Based on these results, it is clear that Run 9 produced the most effective pads for human use, providing highly water absorbent and retentive pads without requiring the use of toxic and corrosive chemicals.

Wet blending and fluffing generally proved to both effectively increase absorption and, when performed on raw fiber, produced the highest absorption values. With the exception of sodium carbonate treated fiber (Run 17), all fiber testing performed with post-blending and fluffing resulted in significantly better absorption values than the same treatment without blending and fluffing.

In addition, an empirical review of a large number of fiber photomicrographs of the type shown here indicates that the effective density of the fibers is correlated with absorption. Processes that had very low absorptions (Run 14, 17, 20, 21) had extremely high effective densities. Photomicrographs of the fibers from these runs indicate opaque fiber masses where individual fibers were not distinguishable. In contrast, treatments that resulted in higher absorption values (Run 9, 15, 16, 18, 19) had lower effective densities where individual fibers are distinguishable, which corresponds to higher void fraction.

Pad absorption was also inversely related to the fiber diameter. The three controls clearly show this trend. Raw fiber pads contain only fiber bundles that appear as thick fibers (diameter 150-250 μm), Rwandan pads contain mainly thin elemental fibers or small fiber bundles (diameter 10-30 μm) with a few thick fibers or fiber bundles (diameter 200 μm), and American pads have exclusively thin fibers (diameter 10-30 μm). Absorption increases from 7.8 to 14 from raw fiber pads to American pads, in conjunction with decreased fiber diameter. This trend is observed in the treated fiber, as highly water-absorptive pads (Run 15, 16, 18, and 19) contained only very thin fiber with diameters of 10-20 μm. Treatments that had low absorption values, such as the steam explosion reactions (runs 10-13), contained primarily thick fiber (diameter 100 μm).

EXAMPLE 2

Effect of Independent Variables on the Mechanical Process

Methods

The methods were designed to produce data that would reveal correlations between three sets of information: material processing, post-processing material performance (uptake and WRV, which are related to absorption and retention as described herein) and post-processing material properties. A standard processing procedure based on the general mechanical process in Example 1 was defined to serve as a basis for comparison. Fourteen parameters of this standard process were varied to determine which of these parameters had the greatest effect on the performance of the final material.

Standard Protocol—Small Blender

A first standard protocol was developed for use in a small 1 L Waring® blender (Model-7012G based on the general process of Example 1. This protocol may sometimes be referred to as the "small blender" process or protocol. The dry, raw banana tree fibers were cut with scissors into pieces 1 to 2 cm in length. Raw cut fiber was loaded with water in a four to one ratio, which was 6 g of fibers to 1.5 cups (355 mL) of water for the small blender. The top of the container and the lid were wrapped with PARAFILM™, and the container was held tightly with paper towels during blending to minimize leakage. The timer was started when the blender was turned on at the highest speed (speed 7), and the blender was run continuously for 5 min. Material trapped between the lid and the container was discarded. Water was removed from the wet blended fibers by vacuum filtration using Corning 0.22 μm filters. The fibers were placed on metal trays and dried for 24 h in an 80° C. oven. Each batch of the oven-dried fibers was separately dry fluffed with the small Waring® blender at highest speed for three 20 sec intervals. In between each interval, the fluffed fibers were pushed down so that the fibers surrounded the blades.

Standard Protocol—Large Blender

A second standard protocol was defined in accordance with blender operating procedures using a large 3.875 L Waring® blender (Model-CB15). This protocol may sometimes be referred to as the "large blender" or "big blender" process or protocol.

The second standard protocol was very similar to first, except for a few key differences. The main differences to note were the water to fiber ratio in the blender, total volume in the blender, interval vs. continuous blending, and how the blender was started. The water to standard raw fiber ratio for wet blending was changed to 1 cup of water to 1 g of raw fiber. The total material in the blender was 6 g of raw fibers and 6 cups of water for the larger blender, while 2 g of raw fibers and 2 cups of water were used for the smaller blender. To prevent blender damage, the blender was gently stabilized by hand and instead of directly going to the highest speed, the blender was started on the lowest speed at which the timer was started. Then, the blender was ramped up to top speed by stepping through each available speed sequentially. Each speed was allowed to run until the machine audibly stabilized, approximately 2 seconds for the large blender and 1 second for the small blender. At the end of the time interval, the ramp down began. The large blender operated for two intervals of 2.5 min, with 1 min rest in between as suggested by the manufacturer. The temperature of the water was also recorded before processing and at the end of each interval.

During the dry fluffing step, a similar ramp up and ramp down, as used in the wet blending step, was used. The final fluffed material was stored in a labeled plastic zip bag until pad performance testing.

Processing Parameter Variations

Within the standard processes, 14 controllable parameters were identified as potentially important variables in pad performance. These parameters relate to fiber preparation (fiber length, presoaking), wet blending (initial water temperature, interval length, total time, speed, filtration method, fiber/water ratio, and amount of fiber), drying (oven temperature and drying time) and dry fluffing (speed, continuous or pulsed, and total time).

The first parameter tested was the initial water temperature for wet blending. A standard temperature of 25° C. was used when this parameter was held constant. Two batches were made in the small blender with all parameters identical to the first standard protocol except the initial water temperatures used were 5° C. and 59° C., using the fiber cut in three lengths: 0.5, 1 and 3 cm. Fibers were caught in the rotor, and the small blender broke during the 3 cm run, and therefore, the runs were repeated using the large blender process. All subsequent tests also used the large blender and standard procedure.

To study the role of water in wet blending, fiber was processed with dry blending alone. From the SEM imaging, this process fractured the fibers transversely much more frequently than longitudinally. This dry blending process produced material that appeared to be raw short cut fibers that could not be formed into a testable pad, demonstrating the importance of the water in the shearing process of wet blending.

Wet blending in short intervals was compared to continuous blending. One batch was processed for ten intervals of 30 sec while the standard procedure is two intervals of 2.5 minutes each.

A kitchen strainer was tested against vacuum filtration in conjunction with blender speed in six total batches: two runs were made at each of the three speeds available on the large blender, one filtered and one strained.

Total wet blending time was tested with three batches where the wet blending times were one minute and 15 seconds, two minutes and 30 seconds, two intervals of two minutes and 30 seconds (standard), and four intervals of two minutes and 30 seconds.

Presoaked fiber was compared to dry fiber by soaking six grams of the standard length raw fiber in six cups of tap water for one week and then proceeding with the standard procedure.

The water to fiber ratio was tested by altering the amount of water and fiber proportions. Six grams of fiber was processed with 3 cups of water and 9 cups of water.

This parameter test also included the effects of changing the total volume in the blender. The amount of fiber placed into the blender also varied from 3 g to 8 g, while keeping water volume constant at 6 cups.

TABLE 5

List of Parameter Values for Screening

| Process | Parameter | Standard Setting | Alterations |
|---|---|---|---|
| Fiber Preparation | Length | 1-2 cm | 0.5, 1, 3 cm |
| | Pre-soaking | None | 1 week |
| Wet Blending | Initial water temperature | 22-25° C. | 5, 59° C. |
| | Interval length | 2:30 min | 30 sec |
| | Total time | 5:00 min | 1:15, 2:30, 10:00 min |
| | Speed | 20,800 rpm | 15,800; 18,000 rpm |
| | Filtration | Vacuum filter | Strainer |
| | Fiber/water ratio | 1 g/1 cup | 1 g/0.5 cup<br>1 g/1.5 cup |
| | Amount of fiber | 6 g | 3, 8 g |
| Drying | Oven temperature | 80° C. | 25° C. (Air), 100° C. |
| | Drying time | 24 hrs | 1.5, 48 hrs |
| Dry Fluffing | Speed | 20,800 rpm | 15,800; 18,000 rpm |
| | Total time | 60 sec | 5, 10, 20, 120 sec |
| | Continuous vs. interval | 3 intervals of 20 sec each | 1 min continuous |

All of the parameter variations apply to the big blender in which the process was performed.

The oven temperature was tested by leaving fibers at room temperature to dry and also by turning the oven up to 100° C.

The length of time that fibers were dried in the oven was also varied. For the drying time, the oven was kept at 80° C., but the fibers were left inside for 1.5 hrs and 48 hrs.

For the dry fluffing step, the speed and time were both examined. The fibers were fluffed at low and medium speeds in addition to the standard high speed. The time was varied (5, 10, 20, 60, and 120 sec) with the blender running on the standard high speed. The fibers were also tested for continuous fluffing of 60 seconds, instead of the standard procedure to dry fluff the material in three intervals of 20 sec.

Performance Testing

To measure the performance of the fibers, small disk pads were prepared as described previously and three different performance tests were performed on the pads: uptake, water retention value (WRV), and pad sinking test. The two main performance tests used were the uptake and WRV tests.

Uptake Test

The uptake test measures the ability of a pad composed of compressed fluffed fiber to absorb water at steady state. Water uptake (U) is the ratio of mass of water absorbed to the mass of the dry test pad:

$$U=m_{water}/m_{dry}=(m_{sat}-m_{dry})/m_{dry} \quad (7)$$

where $m_{water}$ is the mass of the water absorbed, $m_{dry}$ is the mass of the dry fiber disk pad, and $m_{sat}$ is the mass of the wet saturated pad (including fiber mass).

The value of $m_{dry}$ was measured when the disk pad was made. Uptake (U) was designed to measure the mass of a saturated pad ($m_{sat}$), from which the mass of water absorbed ($m_{water}$) could then be calculated.

The uptake test is similar to the absorption (A) test described in Example 1, because $A=(m_{sat}/m_{dry})$. Thus, U and A are related by the equation: $U=A-1$.

The initial Uptake test 1 (U1) used a plastic squeeze bottle to wet the test pad thoroughly. Once enough excess water accumulated in the weigh boat, a timer was started and the pad remained in the water for 1 minute. After the 1 minute, the pad was very gently lifted with tweezers and held vertically to drip for another minute. The original weigh boat was carefully dried with Kim-wipes to retain any loose fibers, and after dripping, the wet pad was placed in the boat and reweighed to obtain the mass of the saturated pad, $m_{sat}$.

An improved Uptake test 2 (U2) was developed to reduce the amount of handling of the pads to increase consistency. The pad was pressed in the same way as for U1, then placed in a 100 mL Petri dish, on top of a wire mesh, which was cut to be slightly smaller than the Petri dish. Water was poured on top of the pad from a beaker until the 100 mL Petri dish was completely full. Water was allowed to soak into the pad for a minimum of 1 min or until there were no visible dry spots. The excess water from the Petri dish was discarded. Using the wire mesh, the pad was removed from the Petri dish and then tilted and held at a 90° angle for 1 min. No direct handling of the pad occurred, as the pad was only held up by the wire mesh. After 1 min, the pad was placed into the weigh boat to measure $m_{sat\ pad}$.

Water Retention Value Test

The second performance test was water retention value (WRV) test, which measured the ability of the fiber pad to retain water after pressure was applied to the pad. In the WRV test, a pressure of 4.5 psi was applied for 1 min. The WRV was calculated using equation (8):

$$WRV=m_{water,WRV}/m_{dry}=(m_{press}-m_{dry})/m_{dry} \quad (8)$$

where $m_{water,\ WRV}$ is the mass of the water absorbed after pad compression, $m_{dry}$ is the mass of the dry fiber disk pad, and $m_{press}$ is the mass of wet pressed pad (including fiber mass).

The WRV test is similar to the retention (R) test described in Example 1, because $R=(m_{press}/m_{dry})$. Thus, WRV and R are related by ($WRV=R-1$).

To calculate WRY, the mass of the pad after it has been pressed was measured ($m_{press}$). To measure this quantity, the saturated pad at the end of the uptake test was placed into the die again and pressed as before at a total pressure of 4.5 psi. After 1 min, the pad was removed using tweezers, placed into a weigh boat, and its mass ($m_{press}$) was measured.

Whole Pad Test

The whole pad test was adapted from the uptake and WRV tests used for the disk pads and was used on four types of whole pads: US ALWAYS™ Maxi, Egyptian ALWAYS™ Maxi, Rwandan pad, and fiber pads of approximately 2 by 8 inches in dimension made from the processed fibrous material of the present invention in a prototype machine that made a pouch with a permeable film on one side and an impermeable sheet on the other. This test was used to measure the performance of whole pads (inner fiber pad and packaging) rather than just the inner pad material. The dry weight of the whole pad ($m_{whole}$) was measured, including the packaging. The fiber weight ($m_{dry}$) without packaging was measured following uptake and WRV tests, after removal of the packaging.

For whole pad uptake measurements, pads were soaked in water for 1 min. Then the pads were held on a mesh tray, which was tilted and held at 90° for 1 min. The weight of the saturated pad was measured as ($m_{sat}$). The uptake test was still defined as in equation (7) above. The $m_{water,U}$ is calculated as:

$$m_{water,U}=m_{sat}-m_{whole} \quad (9)$$

For whole pad WRV tests, the same pressure (4.5 psi) was applied to the whole pad as was applied to the small disk pad. In order to calculate the mass that must be applied to the pad, the area of each pad was measured. The appropriate mass for 4.5 psi was then calculated. The mass needed per pad was generally in the range of 90-120 lbs, hence humans were used to press the pads. To replicate the die cut and punch setup, 8 holes with a diameter of 5/16 inch were drilled into a wooden board, equally spaced in an area the same size as the pads. The saturated pad from the uptake test was placed face down on the wooden board, with the top of the pad in contact with the board with holes. Then a wood slab, slightly larger than the size of the pad and without holes, was placed on top of the whole pad. A person of an appropriate weight was selected to stand on the board for 1 min. The person stood on one foot in the middle of the board to ensure that equal pressure was applied through the whole pad. After 1 minute, the pad was removed from the board and weighed to measure ($m_{press}$). WRV was still defined as before, in equation (8).

In the whole pad test, $m_{press}$ is redefined as:

$$m_{water,WRV}=m_{press}-m_{dry} \quad (10)$$

Pad Sinking Test

In addition to U and WRV, which are equilibrium properties, a pad sinking test was developed to assess the kinetics of water wicking into samples. The pad sinking test was used to test how quickly water is wicked through the pad. A short sinking time represents fast water wicking into the pad.

The processed fiber was pressed into a test pad as outlined above, and the pressed pad was placed on top of water in a beaker filled to a height greater than the thickness of the pad. As the water wicked into the pad, the pad slowly submerged into the water. The timer was started when the pressed pad made contact with the water, and it was stopped when the pad was fully submerged. This test was used on four fiber samples: inner fiber pad material of US ALWAYS™ Maxi pad, fiber pads of the present invention prepared according to the standard protocol, pads made from fiber dried in the oven at 100° C., and pads made of fiber bleached with Oxyboost™ during wet blending.

Statistical Analysis

A two-tailed independent t-test was used. A critical p=0.05 was used to test for significance and ensure that the data were consistent. A one-way ANOVA test was used during parameter screening to determine whether or not uptake and WRV differences for a parameter's values were significant at p=0.05. If a parameter was found to be significant, then one of two tests was performed (Tukey's test for equal sample size or Gabriel's test for unequal sample size) to find which group(s) within each parameter showed the significant differences. Both of the Tukey's and Gabriel's test assume equal variances. The software used for the above statistics is SPSS version 18.

Results

Absorption, retention, uptake, and WRV values given are averages of each run.

To ensure consistency of the data, Runs 2.1 and 2.2 were run using the standard protocol for the large blender to replicate the data from Run 9 of Example 1, where Run 2.1 refers to the first run in example 2, Run 2.2 refers to the second run in Example 2, and so forth.

Absorption and retention were measured as described in Example 1. Results are shown in Table 6.

TABLE 6

Replication of Results from Example 1

| Parameter | avg. of Runs 2.1 and 2.2 (n = 6) | Run 9 from Example 1 (n = 10) |
|---|---|---|
| Absorption ($m_{sat}/m_{dry}$) | 22 ± 2.3 | 21 ± 2 |
| Retention ($m_{ret}/m_{dry}$) | 10.3 ± 0.6 | 9.6 ± 1.5 |

All statistical comparisons of two means were done as described above. For the data in Table 6, the calculated p values for absorption and retention were 0.40 and 0.21, respectively, and the null hypothesis was accepted. These results showed that the data from Run 9 of Example 1 were successfully replicated under the new standard protocol.

The average absorption was 22±2.3 and the average retention was 10.3±0.6, higher than the performance values for the pressed fiber material in the interior of the commercially available pad and consistent with the results from Example 1. When pads assembled from the pressed fibers of this invention were tested using the new performance test, the performance values were greater than those for the commercial pads, confirming that the test results for the disk pads were indicative of whole pad performance.

Run to run consistency was also assessed to ensure processing procedure and performance testing agreement; thus, the absorption and retention for Runs 2.1 and 2.2 were compared (Table 7).

TABLE 7

Consistency of Test Data

| Absorption ($m_{sat}/m_{dry}$) | | Retention ($m_{ret}/m_{dry}$) | |
|---|---|---|---|
| Run 2.1 | Run 2.2 | Run 2.1 | Run 2.2 |
| 19.5 ± 2.6 | 22.5 ± 0.6 | 9.3 ± 0.5 | 9.4 ± 0.7 |

The consistency test ensures that processing and performance testing are the same between Runs 2.1 and 2.2, which were made with the same protocol. The sample size (n) is 3 for all of the runs.

For the run means in Table 7, the p values for absorption and retention were 0.18 and 0.85, respectively, thereby indicating that the experiments produced consistent results.

Parameter Screening

Figure 11:
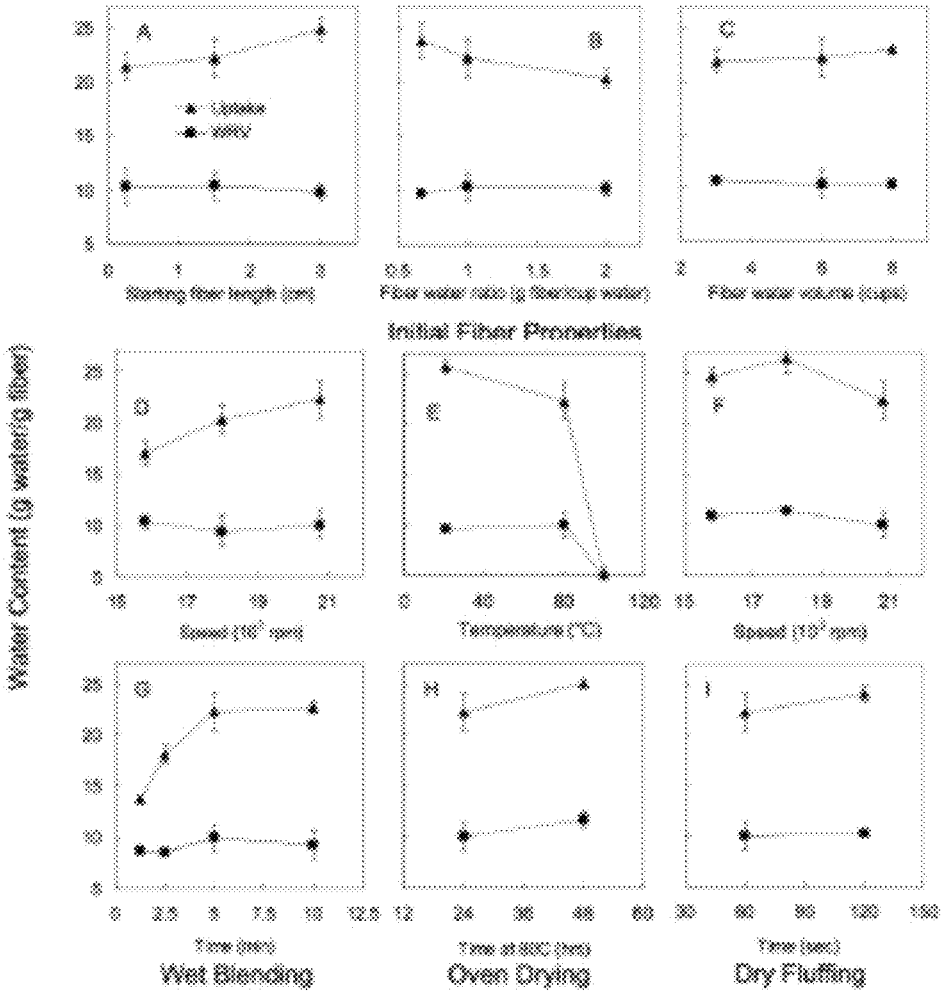
FIG. 11 shows the results on Uptake and water retention value (WRV) results from parameter variation in the big blender (Waring® CB15) expressed as mean±standard deviation error bars for various parameters, including: (A) starting fiber length, (B) fiber water ratio, (C) fiber water volume, (D) and (G) wet blending speed and time, (E) and (H) oven drying temperature and time at 80° C., (F) and (I) dry fluffing speed and time. Sample size n=3 for all data points except for standard conditions where n=6. Based on ANOVA and post-hoc tests, statistical differences were found at p=0.05 in wet blend speed and time, dry fluff speed, and oven temperature.

Of the fourteen parameters tested in the five different stages of the process (see FIGS. 11 and 12), four variables were determined to be statistically important to the performance of the product. The four most significant process parameters were (1) wet blending speed, (2) wet blending total time, (3) drying (oven) temperature, and (4) dry fluffing speed. Although fluffing time was not significant to the performance of the product, it was further studied due to its importance regarding the load placed on the equipment.

The parameters with an insignificant effect on performance were initial fiber length, pre-soaking, wet blending interval time, wet blending fiber amount, wet blending fiber to water ratio, wet blending initial water temperature, filtration method, drying time, fluffing time, and fluffing interval time. Regardless of which parameters were varied, the uptake of the material was never less than the uptake of the control material, the US ALWAYS™ Maxi pad material, which had an uptake of 13.3±1.7. Similarly, the WRV ranged from about 8.5 and 13, versus the control, which had a WRV of 7.33. These results indicate that the process is robust and that scale up to larger equipment, such as a VALLEY BEATER™, is possible.

Of the ten relatively unimportant parameters, a weak relationship between the parameter and performance could have been diluted by the insensitivity of the test and thus determined to be statistically insignificant. For each quick screening test, the parameter values were varied as much possible from the standard process within a reasonable range. For this reason, any parameter not influential enough to be statistically significant when comparing the two most extreme realistic possibilities was determined to be unimportant and was not pursued.

In both of the blenders, one parameter was varied at a time from their respective standard protocols, and the uptake and WRV for variations within that one parameter were measured. Parameters significantly affecting uptake and WRV were later studied in depth.

In the small blender (Waring® 7012G), three parameters were varied: starting fiber length, starting water temperature, and dry fluff time. There was an increase in uptake from 17.7 to 20.6, but a decrease in WRV from 10.8 to 9.3 with increasing initial fiber length. For the starting water temperature, uptake and WRV decreased with room temperature water at 25° C. when compared to water at 5 and 59° C.

With a doubling in dry fluff time from 60 seconds to 120 seconds, the uptake remained the same, around 20.6, and WRV decreased slightly from 9.3 to 8.8. An independent t-test was run on fluff time, and no significant differences were found at p=0.05. No tests were run on fiber length and temperature because of the small sample sizes with some of the parameter values.

A large amount of fiber, relative to the size of the small blender pitcher and the amount of water per batch, in combination with the continuous blending procedures, caused the temperature to increase between 20° C. and 45° C. depending on the starting temperature. Moderate variations in wet blending temperature did not have an effect on the product performance. In the small blender the dry fluffing time had no effect on product performance. The effect of fiber length was inconclusive without the longer fiber length results, which could not be completed due to breakage of the small blender.

When testing was moved to the large blender, the temperature test was not repeated because it was assumed that the role of temperature in the wet blending process would not vary with blender size. Dry fluffing time was not important in the small blender but much less material relative to the volume of the pitcher was used in the large blender. Dry fluffing time was further explored using the large blender to confirm that fluffing time was not important to performance in either case. Lastly, fiber length was also revisited in the large blender to obtain a complete data set and more conclusive results.

A total of 11 processing parameters were assessed in the large blender (Waring® CB15), including: presoaking, fiber water ratio, fiber water volume, starting fiber length, wet blend speed, wet blend time, filtration, oven temperature, oven time, dry fluff time, and dry fluff speed. As in the small blender, each of the above parameters was varied while all other processing aspects were maintained as for the standard protocol for the large blender.

Wet Blending Speed and Time

Two process parameters, blending speed and blending time, were individually determined to be important and were further investigated in conjunction with a more precise test to assess their effect on pad performance (FIGS. 11(D) and (G)). Individually both increased blending speed and time had a positive effect on the uptake of the pads but no effect on the WRV.

There was no statistical difference between the uptake for wet blending time of 5 or 10 minutes. Uptake reaches as asymptote versus blending time at or before five minutes when the processing was done at high speed.

For wet blending speed, there was a significant increase in uptake from 17.0 to 22.3 between the low and the high speeds (15,800 rpm and 20,800 rpm, respectively, FIG. 11(D)). For the wet blending time, there were significant increases in uptake up to 5 minutes, but no further increase up to 10 minutes (FIG. 11(G)). Uptake increased significantly from 13.7 to 18.1 as wet blending time increased from 75 seconds to 2.5 minutes and from 18.1 to 22.3 as wet blending time increased from 2.5 to 5 minutes, whereas it only increased slightly from 22.3 to 22.7 between 5 and 10 minutes of wet blending (FIG. 11(G)).

Drying

The wet processed fiber material was originally vacuum filtered after wet blending to remove the excess water before being dried in the oven. This step was time consuming, inconvenient, and impractical.

Straining was tested as a substitute for vacuum filtration. The trade off with straining is that the smallest fibers are lost and less water is removed before oven drying. However, performance of the strained product was statistically the same as vacuum filtered material. Straining was used for the remainder of the testing. After straining, the material was dried in an oven for 24 hours at 80° C. Drying for 48 hours was statistically the same as from drying for 24 hours but variations in temperature made a large difference in the performance of the material. Material was dried at 100° C. and in ambient air (~21° C.) for 24 hours. When the uptake test was performed on the disk pad dried at 100° C., the pad did not absorb water well, did not saturate, and maintained a dry core.

Uptake decreased significantly from 25.7 to 22.3 to only 5.1 as the drying temperature increased from 21° C. to 80° C. to 100° C. (FIG. 11(E)). For each of the four important parameters described above, there were no statistically significant differences for WRV at p=0.05.

A pad sinking test was performed on several samples and sinking times for various samples are shown in Table 8. The American pad material had the shortest sinking time, whereas the pad made with material dried at 100° C. for 24 hours stayed afloat even after 2 days. The fiber material prepared according to the standard protocol sank in just under a minute (55 seconds), whereas the air dried fibers sank in just 26 seconds. Sinking time (or wicking time) increased as drying temperature increased. As shown in Table 8, the American maxi pad inner material sank the fastest, followed by fiber material wet blended with OxiBoost™, the air dried fiber pad, and a pad prepared according to the standard protocol. The pad dried at 100° C. stayed afloat for more than 2 days. This test roughly represented how quickly each pad imbibed water. The sample size was 1 g for all samples.

TABLE 8

Pad Sinking Test

| Sample | Pad sinking time (sec) |
|---|---|
| American maxi pad inner material | 5 |
| Fiber pad air-dried at 21° C. for 24 hrs | 26 |
| Standard protocol pad | 55 |
| Fiber pad dried at 100° C. for 24 hrs | >2 days |
| Fiber pad wet blended with OXIBOOST ™ | 15 |

Dry Fluffing

Dry fluffing parameters were varied individually, uptake with different fluffing times was not significant different, but effects of fluffing speed were statistically significant (FIGS. 11(F) and (I)). The medium speed fluffing produced the highest uptake. Similar to the runs made testing the wet blending variations, all the product made while varying dry fluffing parameters had uptake values close to the standard and much greater than the control. Therefore, the objective of the experiments changed from maximizing uptake to minimizing the extent of processing while maintaining an uptake and WRV that are competitive with the control pads. For dry fluffing speed, there was a significant decrease in uptake from 26.4 to 22.3 as the speed increased from medium to high (18,000 and 20,800 rpm, respectively).

In the case of dry fluffing, the contents of the blender jar are so light that chance of misalignment between the blender jar and the blending motor are much greater than during wet blending. When this occurs, damage is caused to the connections, and it is thus much more important to minimize both the time and speed of the fluffing process in order to increase the life of the equipment.

Multi-Parameter Variation

Based on the parameter screening, the four parameters deemed to affect uptake and WRV significantly (wet blend speed and time, dry fluff speed, and oven temperature) were studied in more detail in the large blender (Waring® CB15). Additionally, dry fluffing time, particularly a decrease in the time, was also assessed more in-depth because of its relevance in reducing the mechanical load on the blender.

Wet blending time and speed were varied together. As in the case of dry fluffing, the objective was switched from maximizing uptake to minimizing extent of processing. Minimizing extent of processing is important because the production must be efficient and the equipment must be reliable. During this portion of the testing, the new uptake test (U2) was used. The control material, ALWAYS™ Maxi pad material, had an uptake of 21.2±0.6 and WRV=9.9±0.3, and the fiber prepared using the standard large blender protocol had an uptake of 29.2±1.2 and WRV of 11.6±1.2.

Figure 12:
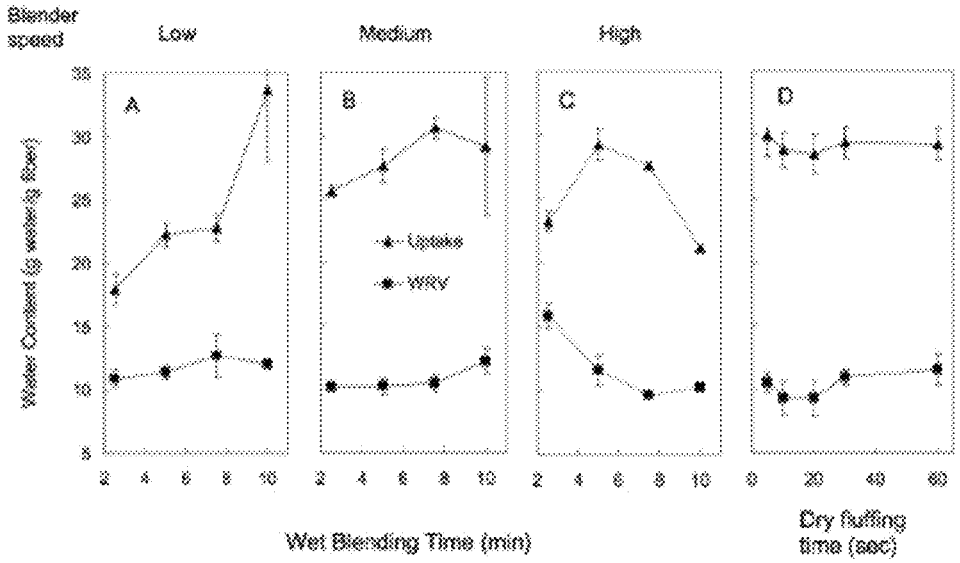
FIG. 12 shows the in-depth effects of wet blending speed and time and dry fluffing time effects. Uptake and WRV for different wet blending speeds and times and dry fluffing time (mean±standard deviation error bars). (A) wet blending time at low speed, (B) wet blending time at medium speed, (C) wet blending time at high speed, (D) dry fluffing time at high speed. Sample size (n) is 3 for all samples except for 5 minutes in (A)-(C) and 60 seconds in (D), where n=14.

Low and medium speed wet blending were tested at various times with a decreased dry fluffing time of twenty seconds (FIGS. 12 (A), (B) and (C)).

Data collected by varying three parameters simultaneously was difficult to analyze in terms of mechanism but are useful for evaluating how the procedure will perform in practice. When wet blending was performed at low speed, performance at all but the highest time (ten minutes) was lower than or approximately the same as ALWAYS™ Maxi pads. At ten minutes, the uptake was greater than the standard.

The fibrous pad produced by wet blending at medium speed performed better than the ALWAYS™ Maxi at even the shortest time of two and a half minutes.

Results were compared using the old uptake test used in parameter screening with the new uptake test used in the more in-depth analysis. From the old to the new uptake test, there was a consistent upward trend in uptake and WRV for both the standard conditions and the American Maxi pad material. In addition, the new test, like the old test, produced significantly higher uptake than WRV for the samples.

A combination of wet blend speed and time was studied in depth. FIG. 12(A)-(C) shows the uptake and WRV for fibers wet blended for various time periods at different speeds. These fibers were dry fluffed at high speed for only 20 seconds rather than the standard procedure of 60 seconds. In the parameter screening, uptake increased with wet blending time, but this phenomenon only occurred with the samples blended at low speed. At the low wet blending speed, uptake increased substantially from 7.5 minutes to 10 minutes blending time; uptake at 10 minutes was the highest of the samples tested at all blending speeds and times. For the medium speed wet blending, uptake increased from 25.7 to 27.6 to 30.7 as blending time increased from 2.5 to 5 to 7.5 minutes. Uptake decreased slightly from 30.7 to 29.2 as time increased from 7.5 to 10 minutes. In both low and medium speed wet blending, WRV was relatively constant around 11 and 12. For high wet blending speed, uptake significantly increased from 23.2 to 29.3 as time increased from 2.5 to 5 minutes, but it began to significantly decrease as wet blending time went beyond 5 minutes. Uptake at 10 minutes was actually much less than the uptake at only 2.5 minutes of wet blending at the same speed. At high speed, WRV decreased as time increased. The performance trends across medium and high wet blending speeds suggest that there is an optimal blending time for uptake and WRV.

The effect of dry fluffing time on uptake and WRV was also assessed. In the parameter screening, increased dry fluffing time did not significantly impact uptake and WRV, a more in-depth study of the decrease in fluffing time was relevant because of its advantage in decreasing the load on the machine. Uptake and WRV did not change significantly with a decrease in fluffing time from the original 60 seconds used in parameter screening to as little as 5 seconds. Uptake remained around 29 and 30, and WRV stayed constant around 10 and 11. These results support the ability to decrease the load on the equipment without significantly sacrificing product performance.

EXAMPLE 3

Alternative Drying Process

Method

Spinning in a home washing machine and drying in a home clothes dryer were tested as an alternative to oven drying. Spinning was able to remove 70% of the water remaining after straining the wet processed fibrous material.

Fibers were wet-blended under standard conditions and strained to remove free water. This material was then divided into eight aliquots, each ranging from 15-25 g. Each aliquot was placed in a pouch fabricated from nylon pantyhose and tied at each end with a knot and labeled with colored string. In four smaller pouches (1-inch diameter), the fibers formed a ball-like structure that distended the hose. In four larger pouches, made using the longer sections of hose, fibers were flattened and torn apart to create a larger flatter area with a thickness of roughly 0.25 in. Each pouch was weighed and all the pouches were placed in a ZIPLOC® plastic bag when not being actively dried.

Pouches were centrifuged in a washing machine (Kenmore Elite Heavy Duty King Size Capacity, 3 Speed Motor/6 Speed Combinations, 12 yrs old) with a basket radius of about 10 in. The pouches were placed in the washer, the dial was set to spin, and the washer started. The pouches were spun for 4 min. Upon removal, the pouches were much lighter and one side of the pouch was generally dry to the touch. Using an estimate of 700 rpm, the gravitational equivalent is about 140-times gravity. The pouches were tumble dried in a Kenmore 90 Plus Series dryer (12 years old). The Mode was set to "Extra Delicate Hand Washables Extra Low," the lowest heated setting.

Each group of four pouches was placed in the dryer, tumbling was started, and one pouch was removed at each drying period of 6, 12, 24, and 48 min. The last larger pouch was dried for an extra 36 minute with no additional heat. Air temperature was measured with a thermocouple placed inside the dryer, and the thermocouple was also used to measure internal temperature of the fiber mass of each removed pouch by wrapping the pouch around the thermocouple and squeezing so as to wet the thermocouple. Surface temperature of each pouch was measured each time the dryer door was opened using an infrared temperature gun (Raytek, STProPlus). Each pouch was placed in a sealed bag and weighed.

The fibers were removed and weighed separately as was the plastic bag with all non-fiber contents. The fibers were allowed to dry an additional 18 hr in room temperature air. From these measurements, the fiber and water weights in the fiber matrix were determined for the start of the experiment prior to centrifuging and at each time of removal from the dryer.

Results

Dryer air temperature reached 85-100° C. within 1 min after drying began. The temperature then dropped and remained in the range of 40-80° C., with most common readings in the range of 50-60° C. Air measurements of 30-35° C. were observed late in some drying periods; a likely cause is that the air heater was turned off for a period near the end of timed drying cycles to allow the contents to cool before the door is opened. Surface temperatures were usually about 30-35° C., and interior temperatures were often about 25-27° C.

Data for drying are summarized in Table 9. Samples 1-4 were the smaller, round pouches, and 5-8 were the larger flattened pouches. Values of absorption U are given as g water/g fibers. FW is the fraction of water initially present that remained in the fiber matrix. Given these results, spinning is quick, effective, and likely to be a valuable addition to process. After spinning, the material would need to finish drying either in the air, in an oven or in a tumble dryer. From this preliminary testing, using a tumble dryer does not seem to be any different from oven drying except for the time required.

TABLE 9

Drying Data

| | Sample Number | | | | | | | |
|---|---|---|---|---|---|---|---|---|
| | 1 | 2 | 3 | 4 | 5 | 6 | 7 | 8 |
| Drying Period (Δt, min) | 6 | 12 | 24 | 48 | 6 | 12 | 24 | 48 + 36 |
| Total Drying time (t, min) | 6 | 18 | 42 | 90 | 6 | 18 | 42 | 90 + 36 |
| U initial | 14.1 | 10.5 | 12.3 | 12.0 | 13.2 | 13.2 | 12.4 | 13.4 |
| U at t min | 3.72 | 3.04 | 2.09 | 1.35 | 4.17 | 2.99 | 1.38 | 0 |
| FW Frac of initial water (%) | 26.3 | 29.1 | 17.0 | 11.2 | 31.5 | 22.8 | 11.1 | 0 |

Conclusions

The initial values of U averaged about 12 in the large round pouches and about 13 in the small flattened pouches. These values are comparable to commercial pads but smaller than values obtained after subsequent dry fluffing. About 70-75% of the water was removed in one 4-min spin cycle of the washing machine, the larger removal occurring with the large round pouches. The remaining water was removed more rapidly in the flattened pouches, for which essentially all of the water was removed by tumble drying at an average of about 50-60° C. for 90 min.

EXAMPLE 4

Bleaching Treatments

Methods

Industry standard sanitary pads in the United States are white, whereas the processed banana fiber pad material is a very light shade of tan. Several different chemicals were used in an attempt to whiten the processed banana fibers. The chemicals were placed in the water solution at the wet-blending stage. All other steps were the same as the standard processing procedures. A 2.13% hydrogen peroxide solution was prepared, with the total volume of the liquid at 6 cups, the same as the standard procedure. For the OxiBoost™ and OxiClean™ solutions, 100 g of each of the dry powders was placed in 6 cups of water.

Results

Bleaching methods were assessed for performance with the new uptake test and the WRV test (see Table 10).

TABLE 10

Effect of Bleaching on Performance of Processed Banana Fibers

| | Uptake | WRV |
|---|---|---|
| Control: Not bleached | 29.4 | 11.8 |
| Hydrogen Peroxide | 26.2 | 11.4 |

TABLE 10-continued

Effect of Bleaching on Performance of Processed Banana Fibers

| | Uptake | WRV |
|---|---|---|
| OXIBOOST ™ | 28.4 | 12.0 |
| OXICLEAN ™ | 28.7 | 11.7 |

The material bleached with hydrogen peroxide was a much lighter shade of tan compared to the original banana fiber. The fibers blended with OxiBoost™ and OxiClean™ actually appeared somewhat yellow after the wet-blending stage. However, all three materials at the end of processing, after the dry blending stage, appeared white.

The ANOVA test showed that there was a significant difference among the control and bleached materials. One unexpected result of the bleached material was that the material soaked up water faster than the control material. In particular, the OxiBoost™-treated material soaked up water the fastest.

EXAMPLE 5

Sodium Chloride Test

Method

Two different concentrations of aqueous NaCl solution were prepared to test for bound charges in our material, at concentrations of 1M and 0.16M. The 0.16M solution gives the same osmotic pressure as human plasma. The solutions were prepared using NaCl salts and distilled water. These solutions were used in the uptake and WRV test, as opposed to water, which was normally used.

Results

There was a large difference in uptake when the 1M NaCl concentration was used. However, the difference was much smaller when the concentration was decreased to a 0.16M concentration (see Table 11).

TABLE 11

NaCl test

| | Uptake | WRV |
|---|---|---|
| Control | 29.4 | 11.8 |
| 1M NaCl | 25.8 | 12.4 |
| 0.16M NaCl | 29.4 | 12.1 |

EXAMPLE 6

Fiber and Pad Property Testing

In addition to characterizing fibers for their water absorption performance variables, the fiber and pad structural and-chemical properties were studied to understand how the mechanical treatment affects the fibers and pad performance.

Structural Properties

The interstices of the pad are very important in fluid uptake of the materials. Pads with many small interstices will absorb more fluid than a pad with larger or fewer interstices. Because interstitial spaces cannot be directly measured, two independent properties, porosity and fiber diameter, can be used to characterized them. Structural properties of banana fiber and their changes throughout processing steps were examined with a scanning electron microscope and an optical microscope. Calipers were used to measure pad thickness.

Scanning Electron Microscope (SEM)

SEM was used to examine fiber structure at a much higher magnification than the optical microscope. The SEM was useful to examine if fibers were broken transversely or longitudinally during processing and where the fractures occurred.

Figure 13:
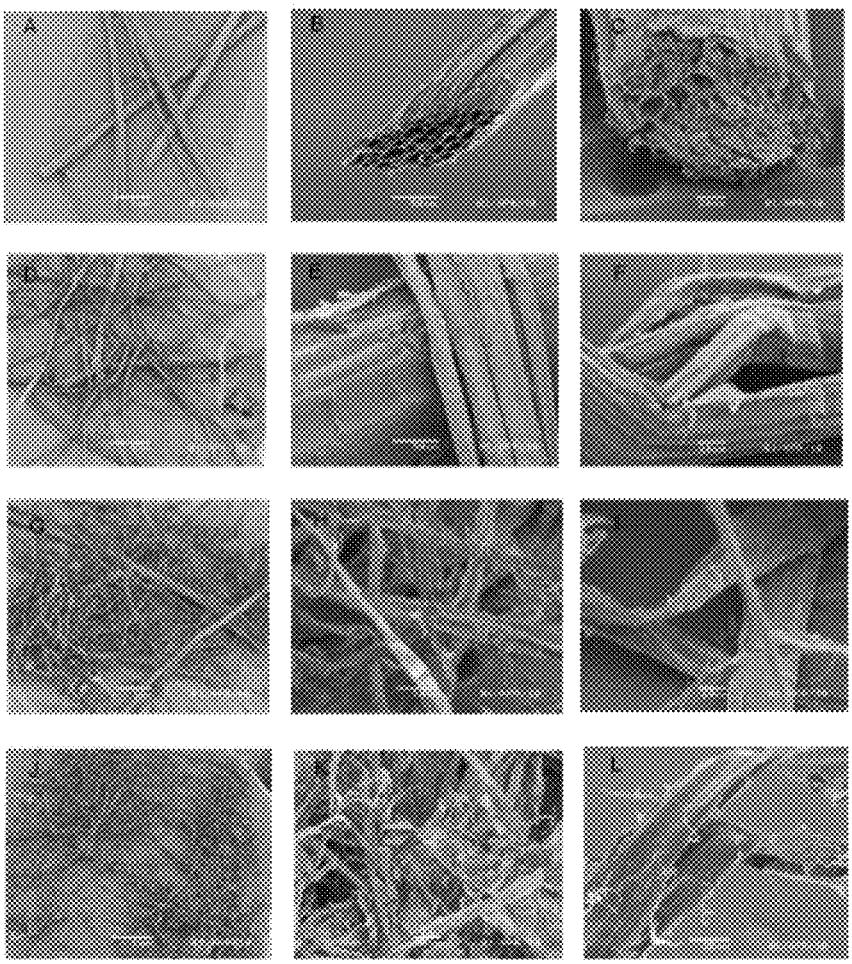
FIG. 13 shows the effect of wet blending time on banana tree fibers using scanning electron microscopy (SEM). Panels (A), (B), (C)—raw fiber cut into 1-2 cm with scissors; (D), (E), (F)—Run 26 wet blend high speed 75 seconds; (G), (H), (I)—Run 30 standard (wet blend high speed 5 minutes); (J), (K), (L)—Run 28 wet blend high speed 10 minutes. All samples, except for raw fiber, have undergone wet blending, drying, and dry fluffing. Magnification bar: Panels, (A), (D), (G), (J)—1 mm; (B), (E), (H), (K)—50 μm; (C), (F), (I), (L)—20 μm.
Figure 14:
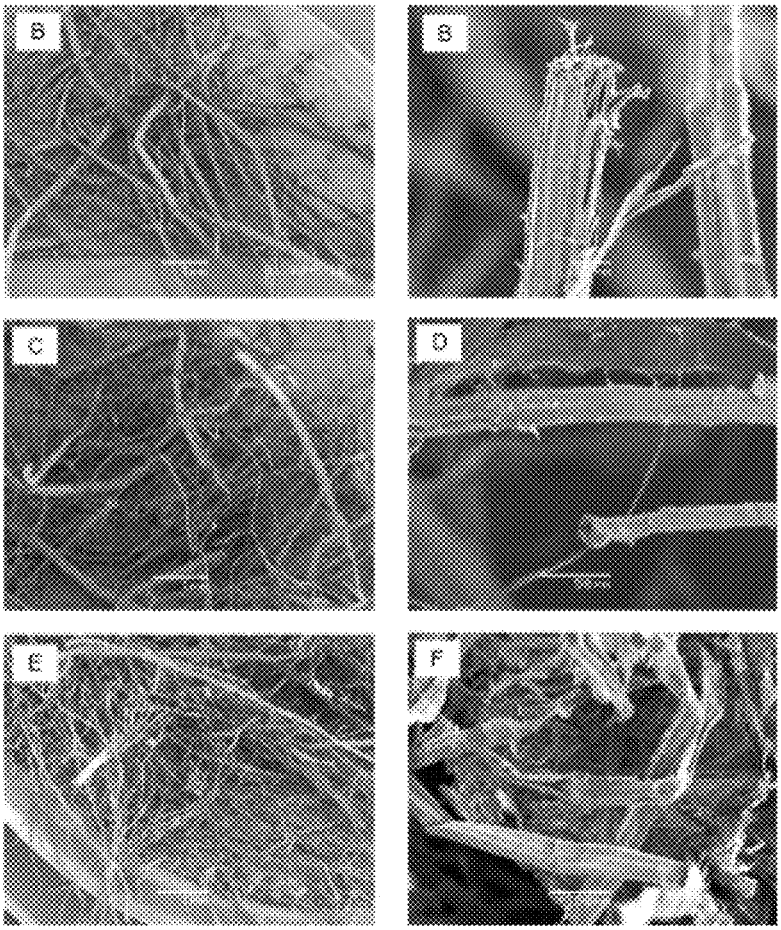
FIG. 14 shows the effect of wet blending speed on banana tree fibers using SEM. All samples were wet blended, dried and dry fluffed. Panels (A), (B)—Run 22B wet blend low speed 5 minutes; (C), (D)—Run 67 wet blend medium speed 5 minutes; (E), (F)—Run 30 standard wet blend high speed 5 minutes. Magnification bar: Panels (A), (C), (E)—1 mm; (B), (D), (F)—50 μm.
Figure 15:
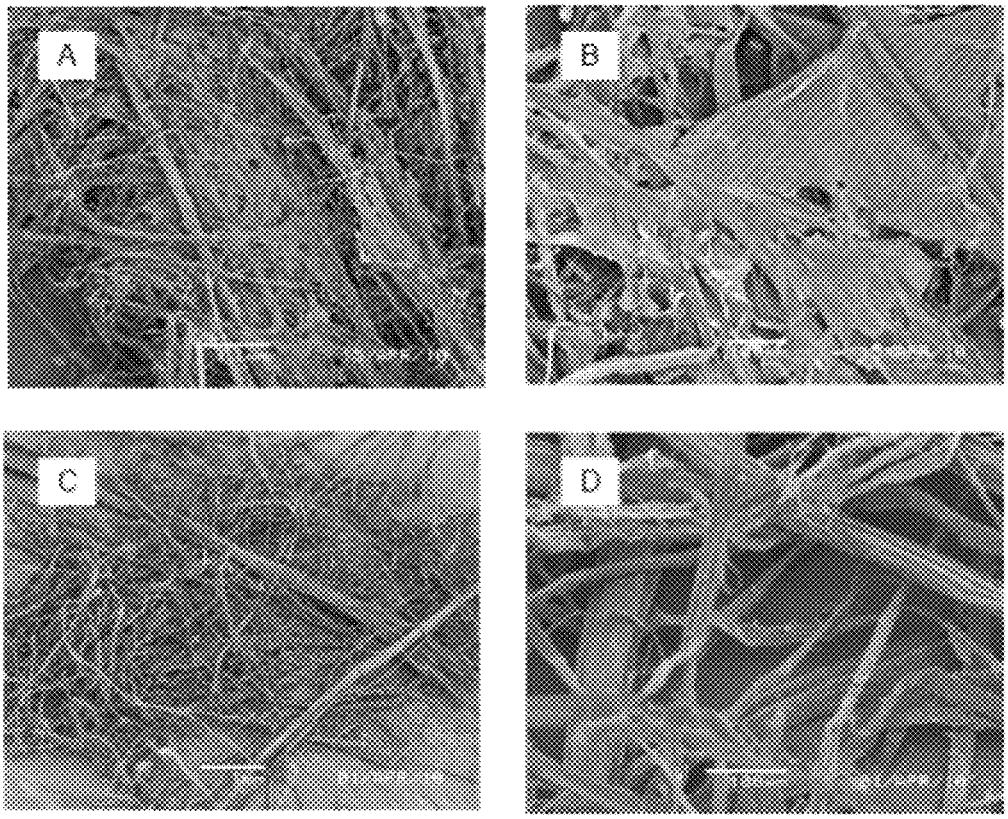
FIG. 15 shows the effect of dry fluffing on banana tree fibers using SEM. Panels (A), (B)—Run 30 standard after wet blending and drying, but no dry fluffing; (C), (D)—Run 30 standard after wet blending, drying, and dry fluffing. Magnification bar: Panels (A), (C)—1 mm; (B), (D)—100 μm.

Samples were plated with 6 nm of platinum and examined in a scanning electron microscope (JOEL JSM-6060) in the Institute for Soldier Nanotechnologies Lab at MIT. Images having magnification bars in the images of 1 mm to 5 μm were taken (FIGS. 13, 14 and 15). SEM pictures were used to study how the fibers change through each processing step.

FIG. 13 shows the effect of wet blending time on the fibers. A raw fiber is actually a fiber bundle composed of individual tube shaped fibers (FIG. 13, panels (A)-(C)). After 75 seconds of wet blending, the fiber bundles have begun to loosen, and as a result, a textured surface between the inner fibers is revealed (FIG. 13, panels (D)-(F)). At the standard wet blending time of five minutes, most of the bundles are loose, and the separated individual elemental fibers are split open into ribbons. These individual elemental fibers also appeared to be flattened, and hair-like structures are beginning to develop around the edges (FIG. 13, panels (G)-(I)). After 10 minutes of blending, almost all of the initial large fiber bundles were transformed into elemental fibers. There were also more ribbons and hair-like structures, and the overall sample structure seemed to be disrupted (FIG. 13, panels (J)-(L)).

FIG. 14 shows the effects of wet blending speed on the fibers. The fiber diameter seemed to decrease with an increase in wet blending speed. In the low speed wet blended material, layers were starting to peel from the original raw fiber bundle, and the big bundles seemed to separate into smaller fibers (FIG. 14, panels (A), (B)). At medium blending speed, sheets were present with hair-like structures frayed at the edges (FIG. 14, panels (C), (D)). At high speed, the standard process breaks the bundles longitudinally into finer fiber bundles consisting of individual elemental fibers that looked somewhat opened or flattened (FIG. 14, panels (E), (F)).

Drying temperature was a significant processing parameter but the SEM pictures of the samples dried at various temperatures for 24 hours appear to be similar. For example, as the drying temperature increased, the fiber bundle widths, the occurrence of flattened fibers, the amount of peeling and hair-like structures, and even the surface texture all appeared consistent across the images.

The changes in banana fiber properties with dry fluffing were also studied with SEM. The dried un-fluffed material was held together by large spread-out sheets (FIG. 15, panels (A), (B)). In addition, there were two main types of sheets: a smooth sheet and a brick-like sheet that looked like a butterfly wing (FIG. 15(B)). By comparison, FIG. 15, panels (C) and (D) show the material after wet blending, drying, and dry fluffing under standard protocol.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

While various embodiments have been described, there are alterations, permutations, and equivalents that fall within the scope of the claims. It should be noted that there are many alternative ways of implementing the disclosed methods and apparatuses. It is therefore intended that the following appended claims be interpreted as including all such alterations, permutations, and equivalents.

What is claimed is:

1. A process for producing a water-absorbent porous fibrous matrix comprising:

(a) mechanically processing raw banana stem fibers with water;

(b) drying the wet mechanically processed banana stem fibers to substantially remove the water content; and (c) dry-fluffing the dried banana stem fibers by mechanical processing to provide a porous fibrous matrix, wherein the porous fibrous matrix comprises fiber bundles having an average diameter of about 200 μm, and individual fibers within each fiber bundle having an average diameter of about 10 μm to about 40 μm.

2. The process of claim 1, wherein the wet mechanical processing step (a) comprises crushing, grinding, refining, beating, high speed blending, or a combination of these processes.

3. The process of claim 1, wherein the wet mechanical processing step (a) is performed using a blender.

4. The process of claim 1, wherein the dry-fluffing step (c) is performed using a blender.

5. The process of claim 1, further comprising forming the porous fibrous matrix into a water-absorbent and water-retentive pad.

6. The process of claim 1, wherein the porous fibrous matrix has (i) an absorption of at least 9 $\text{grams}_{wet\ saturated\ pad}/\text{gram}_{dry\ fiber\ pad}$; or (ii) a retention of at least 8 $\text{grams}_{wet\ pressed\ pad}/\text{gram}_{dry\ fiber\ pad}$, or both.

* * * * *